US009439009B2

(12) United States Patent
Kim et al.

(10) Patent No.: US 9,439,009 B2
(45) Date of Patent: Sep. 6, 2016

(54) METHOD OF FITTING HEARING AID CONNECTED TO MOBILE TERMINAL AND MOBILE TERMINAL PERFORMING THE METHOD

(71) Applicant: SAMSUNG ELECTRONICS CO., LTD., Suwon-si (KR)

(72) Inventors: Yu-na Kim, Suwon-si (KR); Yang-wook Kim, Hwaseong-si (KR); Ik-Soo Kim, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 14/085,234

(22) Filed: Nov. 20, 2013

(65) Prior Publication Data

US 2014/0211972 A1 Jul. 31, 2014

(30) Foreign Application Priority Data

Jan. 31, 2013 (KR) ..... 10-2013-0011498

(51) Int. Cl.
*H04R 25/00* (2006.01)

(52) U.S. Cl.
CPC ..... *H04R 25/70* (2013.01)

(58) Field of Classification Search
CPC ..... H04M 1/2475; H04M 1/6066; H04M 1/7253; H04R 2225/41; H04R 2225/55; H04R 2460/07; H04R 1/1016; H04R 5/033; H04R 5/04; H04R 2201/107; H04R 2410/05; H04R 2499/11; H04R 25/02; H04R 3/005; H04R 2225/025; H04R 2410/01; H04R 2430/01; H04R 25/48; H04R 25/505; H04R 25/558; G10K 2210/01
USPC ..... 381/314–315, 74, 328, 71.6, 309, 311, 381/317, 71.1, 23.1, 370, 94.1; 455/570
See application file for complete search history.

(56) References Cited

U.S. PATENT DOCUMENTS 6,208,861 B1 * 3/2001 Suzuki ..... H04W 48/16 455/428
7,986,790 B2 7/2011 Zhang et al.
(Continued)

FOREIGN PATENT DOCUMENTS

EP 2 549 397 A1 1/2013
WO 2009/026959 A1 3/2009
WO 2012/066149 A1 5/2012

OTHER PUBLICATIONS

International Search Report for PCT/KR2013/011889 dated Mar. 31, 2014 [PCT/ISA/210].
(Continued)

*Primary Examiner* — Paul S Kim
*Assistant Examiner* — Norman Yu
(74) *Attorney, Agent, or Firm* — Sughrue Mion, PLLC

(57) ABSTRACT

A method of fitting a hearing aid connected to a mobile terminal is provided. The method may include acquiring location information of a location of the mobile terminal, transmitting the location information to a server, receiving, from the server, information about at least one recommended fitting parameter model adapted to hearing conditions of the location and hearing characteristics of a user of the hearing aid, and displaying the information about the at least one recommended fitting parameter model. The method may also include receiving a fitting parameter model selected by the user from among the at least one recommended fitting parameter model, and controlling the hearing aid to function according to the received fitting parameter model.

38 Claims, 22 Drawing Sheets

(56) References Cited

U.S. PATENT DOCUMENTS

| | | | | |
|---|---|---|---|---|
| 2005/0283263 | A1 | 12/2005 | Eaton et al. | |
| 2006/0078140 | A1* | 4/2006 | Goldstein | 381/312 |
| 2008/0037798 | A1 | 2/2008 | Baechler et al. | |
| 2009/0047994 | A1* | 2/2009 | Sommer et al. | 455/556.1 |
| 2009/0290718 | A1* | 11/2009 | Kahn | H03G 3/32 381/57 |
| 2011/0200213 | A1* | 8/2011 | Knox | 381/314 |
| 2011/0293123 | A1* | 12/2011 | Neumeyer et al. | 381/314 |
| 2012/0183164 | A1 | 7/2012 | Foo et al. | |
| 2013/0177188 | A1* | 7/2013 | Apfel et al. | 381/315 |
| 2013/0177189 | A1* | 7/2013 | Bryant et al. | 381/315 |

OTHER PUBLICATIONS

Written Opinion for PCT/KR2013/011889 dated Mar. 31, 2014 [PCT/ISA/237].

Notification of Transmittal of International Search Report and Written Opinion for PCT/KR2013/011889 dated Mar. 31, 2014 [PCT/ISA/220].

Communication dated Jul. 16, 2016, issued by the European Patent Office in counterpart European Application No. 13873235.9.

* cited by examiner

METHOD OF FITTING HEARING AID CONNECTED TO MOBILE TERMINAL AND MOBILE TERMINAL PERFORMING THE METHOD

CROSS-REFERENCE TO RELATED PATENT APPLICATION

This application claims priority from Korean Patent Application No. 10-2013-0011498, filed in the Korean Intellectual Property Office on Jan. 31, 2013, the disclosure of which is incorporated herein by reference in its entirety.

BACKGROUND

1. Field

Apparatuses and methods consistent with exemplary embodiments relate to a method of fitting a hearing aid connected to a mobile terminal and a mobile terminal performing the method.

2. Description of the Related Art

Hearing loss has increased partially due to the use of sound systems, an increase in the elderly population, and an increase in noisy environments. Due to the increase in demand for hearing aids and the development of digital hearing aids, there is also an increase in demand for high performance hearing aids capable of providing sounds properly fitted to various situations and surroundings of users' daily lives.

SUMMARY

One or more exemplary embodiments provide a method of fitting a hearing aid connected to a mobile terminal and a mobile terminal performing the method.

One or more exemplary embodiments also provide a computer recordable recording medium having stored thereon a program for executing the method.

According to an aspect of an exemplary embodiment, there is provided a method of fitting a hearing aid connected to a mobile terminal, the method including: acquiring location information of a location of the mobile terminal; transmitting the location information to a server; receiving, from the server, a fitting parameter model adapted to hearing conditions of the location and hearing characteristics of a user of the hearing aid; and controlling the hearing aid to function according to the received fitting parameter model.

According to another aspect of an exemplary embodiment, there is provided a method of fitting a hearing aid connected to a mobile terminal, the method including: acquiring location information of a location of the mobile terminal; transmitting the location information to a server; receiving, from the server, information about at least one recommended fitting parameter model adapted to hearing conditions of the location and hearing characteristics of a user of the hearing aid; displaying the information about the at least one recommended fitting parameter model; receiving a fitting parameter model selected by the user from among the at least one recommended fitting parameter model; and controlling the hearing aid to function according to the received fitting parameter model.

According to another aspect of an exemplary embodiment, there is provided a non-transitory computer-readable recording medium having recorded thereon a program for executing any one of the methods.

According to another aspect of an exemplary embodiment, there is provided a mobile terminal connected to a hearing aid, the mobile terminal including: a positioning system configured to acquire location information about a location of the mobile terminal; a communication interface configured to transmit the location information of the mobile terminal to a server, and receive, from the server, a fitting parameter model corresponding to hearing characteristics of the user from among fitting parameter models of the hearing aid, that are mapped to the location; and a setting unit configured to transmit a signal to control the hearing aid according to the received fitting parameter model.

As described above, by acquiring the current location of a user by using a positioning system, receiving a fitting parameter model fitted to be suitable for the current location of the mobile terminal from a server, and changing the current fitting parameter model of a hearing aid for the received fitting parameter model, the user may use a hearing aid fitted with a fitting parameter model optimized according to the current location. The fitting parameter model received from the server is a fitting parameter model fitted in consideration of location characteristics and surroundings, and thus, the hearing aid may provide a sound fitted to be suitable for various situations and various surroundings of the user's daily life.

In addition, the user may automatically or manually set a fitting parameter model fitted to be suitable for the location of the user into the hearing aid, and thus, the user's convenience may be greatly improved.

Additional aspects will be set forth in part in the description which follows and, in part, will be apparent from the description, or may be learned by practice of the presented embodiments.

BRIEF DESCRIPTION OF THE DRAWINGS

The above and other features and aspects will become more apparent by describing in detail exemplary embodiments thereof with reference to the attached drawings in which.

DETAILED DESCRIPTION OF EXEMPLARY EMBODIMENTS

Figure 1:
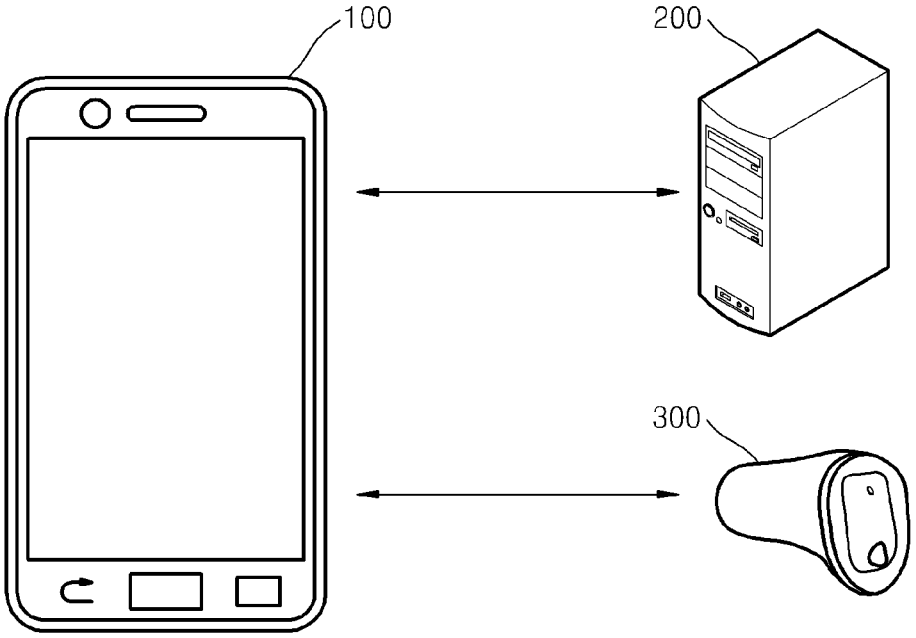
FIG. 1 is a diagram for explaining an environment for fitting a hearing aid by using a global positioning system (GPS) in a mobile terminal, according to an exemplary embodiment.

The following detailed description is provided to assist the reader in gaining a comprehensive understanding of the methods, apparatuses, and/or systems described herein. Accordingly, various changes, modifications, and equivalents of the methods, apparatuses, and/or systems described herein will be suggested to those of ordinary skill in the art. The progression of processing steps and/or operations described is an example; however, the sequence of and/or operations is not limited to that set forth herein and may be changed as is known in the art, with the exception of steps and/or operations necessarily occurring in a particular order. In addition, respective descriptions of well-known functions and constructions may be omitted for increased clarity and conciseness.

Reference will now be made in detail to embodiments, examples of which are illustrated in the accompanying drawings, wherein like reference numerals refer to the like elements throughout. In this regard, the present exemplary embodiments may have different forms and should not be construed as being limited to the descriptions set forth herein. Accordingly, the exemplary embodiments are merely described below, by referring to the figures, to explain aspects of the present description. As used herein, the term "and/or" includes any and all combinations of one or more of the associated listed items.

The term " . . . unit" used in the embodiments indicates a component including software or hardware, such as a Field Programmable Gate Array (FPGA) or an Application-Specific Integrated Circuit (ASIC), and the " . . . unit" performs certain roles. However, the " . . . unit" is not limited to software or hardware. The " . . . unit" may be configured to be included in an addressable storage medium or to reproduce one or more processors. Therefore, for example, the " . . . unit" includes components, such as software components, object-oriented software components, class components, and task components, processes, functions, attributes, procedures, subroutines, segments of program code, drivers, firmware, microcode, circuits, data, a database, data structures, tables, arrays, and variables. A function provided inside components and " . . . units" may be combined into a smaller number of components and " . . . units", or further divided into additional components and " . . . units".

The term "module" as used herein means, but is not limited to, a software or hardware component, such as an FPGA or ASIC, which performs certain tasks. A module may advantageously be configured to reside on an addressable storage medium and configured to execute on one or more processors. Thus, a module may include, by way of example, components, such as software components, object-oriented software components, class components and task components, processes, functions, attributes, procedures, subroutines, segments of program code, drivers, firmware, microcode, circuitry, data, databases, data structures, tables, arrays, and variables. The functionality provided for in the components and modules may be combined into fewer components and modules or further separated into additional components and modules.

Although the terms used herein are generic terms which are currently widely used and are selected by taking into consideration functions thereof, the meanings of the terms may vary according to the intentions of persons skilled in the art, legal precedents, or the emergence of new technologies. Furthermore, some specific terms may be randomly selected by the applicant, in which case the meanings of the terms may be specifically defined in the description of the exemplary embodiment. Thus, the terms should be defined not by simple appellations thereof but based on the meanings thereof and the context of the description of the exemplary embodiment. As used herein, expressions such as "at least one of," when preceding a list of elements, modify the entire list of elements and do not modify the individual elements of the list.

It will be understood that when the terms "includes," "comprises," "including," and/or "comprising," when used in this specification, specify the presence of stated elements and/or components, but do not preclude the presence or addition of one or more elements and/or components thereof. As used herein, the term "module" refers to a unit that can perform at least one function or operation and may be implemented utilizing any form of hardware, software, or a combination thereof.

FIG. 1 is a diagram illustrating an environment for fitting a hearing aid by using a positioning system such as at least one of a global system, a local positioning system, and a site-wide system according to one or more exemplary embodiments. A global system may be a global navigation satellite system (GNSS) that could be, for example, at least one of a Global Positioning System (GPS), Global Navigation Satellite System (GLONASS), Galileo, BeiDou Navigation Satellite Systems (BDS), Indian Regional Navigational Satellite System (IRNSS), and Quasi-Zenith Satellite System (QZSS). A site-wide system may include an indoor positioning system optimized for use within buildings, for example, a low-power wireless indoor location system using multiple ultrasonic receivers.

Further, a local positioning system may include the use of beacons with limited range which may include at least cellular base stations, Wi-Fi access points, radio towers, and/or land-based positioning transmitters that transmit to specialized receivers to determine a position such as the long range navigation (LORAN) system or Decca Navigator System. A local system may use any one of at least triangulation, trilateration, and/or multilateration (for example Observed Time Difference Of Arrival (OTDOA) as disclosed in rel9 E-UTRA LTE disclosures) to calculate a position of a user device and/or mobile terminal. Additionally, a local positioning system may be a mobile device tracking system such as, for example, Enhanced Cell ID (E-CEllID), as defined in the 3GPP standards, a Wi-Fi positioning system, or some other network-based or handset-based system. Some of the technologies that may be used may include at least time of flight systems, spatial scan systems, inertial sensing systems, phase difference systems, direct field sensing systems, and hybrid systems.

Referring to FIG. 1, the environment for fitting a hearing aid by using a positioning system includes a mobile terminal 100, which may also be called user equipment (UE), a server 200 and a hearing aid 300. For convenience of explanation, only a single mobile terminal 100 and a single server 200 are illustrated in FIG. 1. However, one or more exemplary embodiments are not limited thereto, and a plurality of mobile terminals may be connected to a plurality of servers.

While FIG. 1 illustrates only components related to an exemplary embodiment, it will be understood by one of ordinary skill in the art that other general-purpose components may be further included in the environment.

The mobile terminal 100 communicates with the server 200 and controls the hearing aid 300. According to an exemplary embodiment, the mobile terminal 100 may provide location information, which is information about a user's location, to the server 200 through communication with the server 200, and may receive a fitting parameter model from the server 200. Also, the mobile terminal 100 controls the hearing aid 300 connected through searching to set a desired fitting parameter value into the hearing aid 300.

Examples of the mobile terminal 100 may include a mobile phone, a smart phone, a notebook computer, a terminal for digital broadcasting, a personal digital assistant (PDA), a portable multimedia player (PMP), a navigation, a tablet personal computer (PC), etc. However, one or more exemplary embodiments are not limited thereto, and examples of the mobile terminal 100 include all mobile apparatus capable of communicating with the server 200 and controlling the hearing aid 300. Details of a mobile terminal according to one or more embodiments are described below with reference to FIG. 2.

The server 200 communicates with the mobile terminal 100, and provides data stored in the server 200 or provides various services by using programs that are executed in the server 200. In this case, the server 200 may be a cloud server 200 but is not limited thereto. According to the current exemplary embodiment, the server 200 receives location information of a user from the mobile terminal 100, and provides a fitting parameter model determined based on the received location information of the user and hearing characteristics of the user to the mobile terminals 100.

The server 200 stores fitting parameter models of the hearing aid 300, which are mapped to each location, along with the hearing characteristics. In addition, the server 200 may further store situation information for the fitting parameter models, test sounds, and satisfaction evaluations. The server 200 may store a record and an error zone in which an abnormality in functionality of the hearing aid 330 has occurred, with respect to each location.

The mobile terminal 100 and the server 200 may transmit data to each other and receive data from each other through a wire or wireless network or wired serial communication by using their respective communication modules. Examples of the network may include the Internet, a local area network (LAN), a wireless LAN, a wide area network (WAN), and a personal area network (PAN). However, one or more exemplary embodiments are not limited thereto, and the network may be another type of network capable of transmitting and receiving information.

A hearing aid 300 is an apparatus for outputting sound that compensates for hearing loss so that a user can sufficiently hear a sound which the user cannot otherwise hear well due to the hearing loss. The hearing aid 300 outputs a sound that compensates for hearing loss of a user by detecting sounds around the user and adjusting the detected sounds according to fitting parameter values of the hearing aid 300. The fitting parameter values of the hearing aid 300 may be set based on a fitting parameter model received from a server 200, and may output a sound according to the set fitting parameter values.

A series of fitting parameter values set into the hearing aid 300 is referred to as a fitting parameter model. The fitting parameter values may be determined for each channel and for each frequency. The fitting parameter values are determined based on hearing characteristics of a user, and are values adjusted to output a sound for compensating for a hearing loss of a user.

The hearing characteristics of a user are data indicating whether the user can hear sounds within certain frequency bands and to which extent of loudness. The fitting parameter values are determined to be values minutely fitted based on the hearing characteristics and use an environment of a user so that the hearing aid 300 may output a sound for sufficiently compensating for the hearing loss of a user.

The mobile terminal 100 may search for the hearing aid 300 through paring and may then be connected to the searched hearing aid 300. The mobile terminal 100 and the hearing aid 300 may be connected to each other through a local area network, such as Bluetooth, Radio Frequency Identification (RFID), Infrared Data Association (IrDA), Ultra Wideband (UWB), ZigBee, or Wi-Fi Direct (WFD) Near Field Communication (NFC), by using their respective communication modules.

Figure 2:
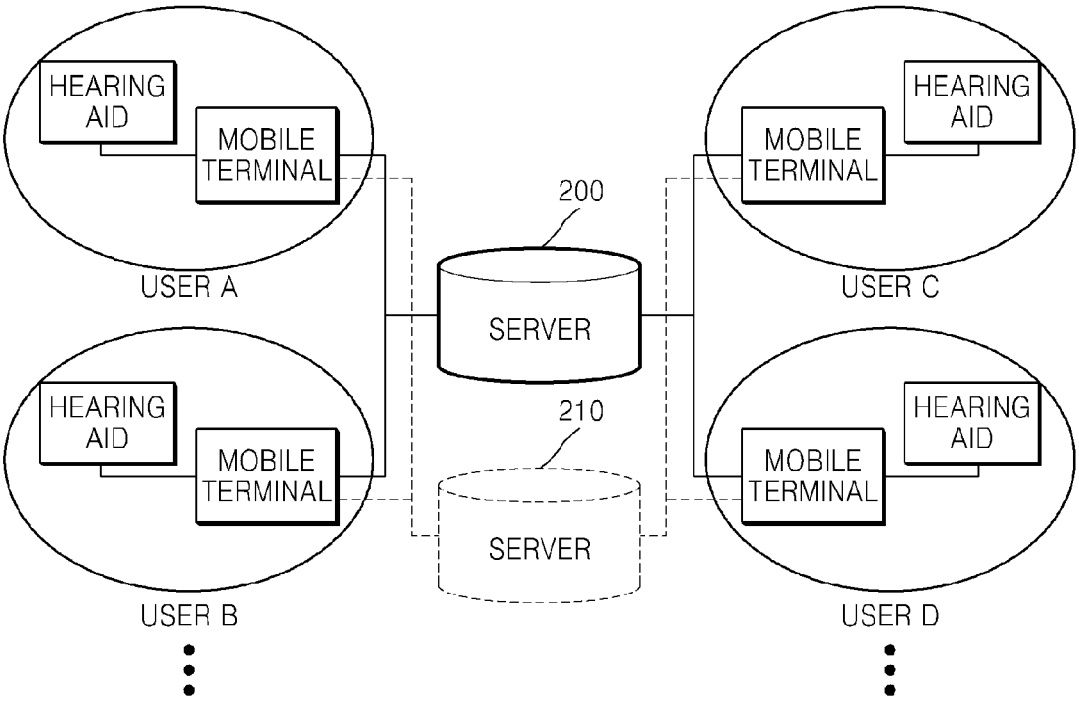
FIG. 2 is a diagram for explaining a method of providing a fitting parameter model corresponding to a location of each user from a server to each user's mobile terminal, according to an exemplary embodiment.

FIG. 2 is a diagram for explaining a method of providing a fitting parameter model corresponding to a location of each user from a server to each user's mobile terminal, according to an exemplary embodiment.

Users A, B, C, and D receive respective fitting parameter models from the server 200 by using a positioning system 110.

For example, if the users A, B, and C are located in the same location, pieces of location information that are obtained by the respective mobile terminals of the users A, B, and C will be the same. If the users A and B have the same hearing characteristic and the user C has hearing characteristics that are different from those of the users A and B, the server 200 may transmit a same fitting parameter model #1 to the users A and B because the users A and B have the same location information and the same hearing characteristics. On the other hand, the user C may receive another fitting parameter model #2 from the server 200.

In this case, if the user A feels uncomfortable about the received fitting parameter model #1, a fitting of the user A's hearing aid may be performed again by using a fitting program of the user A's mobile terminal and a fitting parameter model #3 obtained as a result of the fitting may be uploaded into the server 200.

Accordingly, the user B may receive a more accurate fitting parameter model #3, which the user A having the same hearing characteristics as the user B has uploaded, from the server 200, and may use the received fitting parameter model #3 instead of the previously received fitting parameter model #1.

According to another exemplary embodiment, the server 200 may compare the fitting parameter model #3 uploaded by the user A with a previous fitting parameter model and may analyze whether a sound of a low frequency band is not heard well in a region. In addition, based on the analysis result, the server 200 may generate a fitting parameter model #4 that is obtained by modifying the intensity of the sound of the low frequency band in the fitting parameter model #2 stored in the server 200, and may provide the fitting parameter model #4 to the user C.

As in the above exemplary embodiments, users may register fitting parameter models optimized with respect to location characteristics of a region and hearing characteristics of the users to the server 200 by using the positioning system, and may be provided with the registered fitting parameter model from the server 200.

For example, if the region is a baseball stadium, the server 200 may provide a fitting parameter model, in which location characteristics of the baseball stadium are considered, to a user's terminal. Alternatively, if the region is a concert hall, the server 200 may provide a fitting parameter model, in which location characteristics of the concert hall are considered, to a user's terminal.

Accordingly, a fitting parameter model, in which location characteristics of the region are considered, may be shared with other users through the server 200.

In another exemplary embodiment, if the user D is located in a region, which is different from regions in which the users A, B, and C are located, and ascertains that the user D's hearing aid does not correctly operate in the region, the user D may transmit location information of the region to the server 200 by using the user D's mobile terminal. The server 200 may register a region, in which an abnormality of the user D's hearing aid has occurred, as an error zone based on the information received from the user D. Accordingly, when the users A, B, and C enter into the current location of the user D, the server 200 may transmit a message warning that the current location corresponds to the error zone to terminals of the users A, B, and C.

In another exemplary embodiment, by operating different servers 200 and 300 for each hearing aid maker, a fitting parameter model that is most suitable for characteristics of a user's hearing aid may be provided to the user.

However, exemplary embodiments relating a method of fitting a hearing aid connected to a mobile terminal, a mobile terminal for performing the method, and a related recording medium are not limited to the exemplary embodiments described with reference to FIG. 2.

Figure 3:
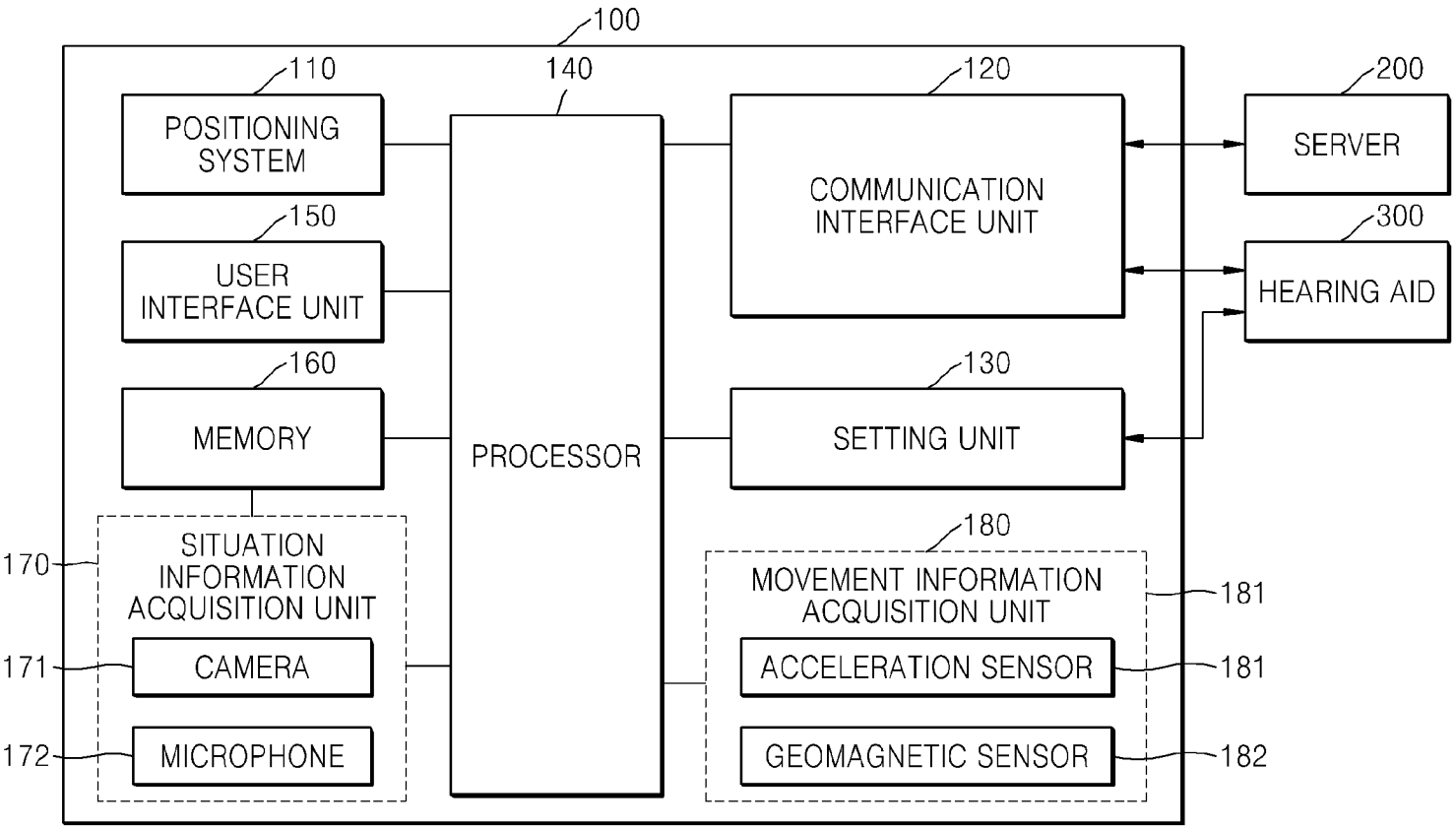
FIG. 3 is a block diagram of a mobile terminal according to an exemplary embodiment.

FIG. 3 is a block diagram of a mobile terminal 100 according to an exemplary embodiment. Referring to FIG. 3, the mobile terminal 100 may include a positioning system 110, a communication interface unit 120, a setting unit 130, a processor 140, a user interface unit 150, and a memory 160. The mobile terminal 100 may further include a situation information acquisition unit 170 for acquiring situation information of a user and/or a movement information acquisition unit 180 for acquiring movement information of a user.

The positioning system 110 acquires location information of the mobile terminal 100, which is information about the location of the mobile terminal 100. According to an exemplary embodiment, the positioning system 110 may be a system that accurately measures the location of an object by using a plurality of satellites, such as GPS. The location information that is acquired by the positioning system 110 may have latitude, longitude, altitude, velocity, azimuth, etc. According to the current exemplary embodiment, the positioning system 110 may acquire the location information in a form of coordinates including the latitude, the longitude, and the altitude, and the mobile terminal 100 may transmit the location information acquired in the form of coordinates to the server 200. However, one or more exemplary embodiments are not limited thereto. That is, the positioning system 110 may further use other information, which may be acquired by using a satellite system of the positioning system 110, as the location information.

The communication interface unit 120 transmits location information of a user of the mobile terminal 100 to the server 200. The mobile terminal 100 may further transmit hearing characteristics of the user, situation information of the user, or movement information of the user other than the location information of the user to the server 200. In this regard, details are described with reference to FIGS. 8 through 11.

According to another exemplary embodiment, the communication interface unit 120 may transmit hearing characteristics of the user or authentication information of the user to the server 200. For example, the server 200 may receive the hearing characteristics of the user or the authentication information of the user directly from the mobile terminal 100 or via another server. In this regard, details are described with reference to FIG. 6C.

According to another exemplary embodiment, a communication interface unit 120 may further transmit feedback indicating an evaluation of satisfaction with a fitting parameter model to a server 200. Alternatively, after performing a fitting of a hearing aid 300 in a mobile terminal 100, the communication interface unit 120 may upload information about a location at which the fitting has been performed and an obtained fitting parameter model into the server 200. In this case, the communication interface unit 120 may further upload information about the situation when fitting into the server 200.

In addition, the communication interface unit 120 may receive information about a fitting parameter model or a recommended fitting parameter model from the server 200. In another exemplary embodiment, a communication interface unit 120 may further receive a message informing a user that there is a recommended fitting parameter model, which corresponds to the location information of the user and the hearing characteristics of the user, or a warning message informing a user of an error zone in which an abnormality of a hearing aid has occurred, from a server 200.

The communication interface unit 120 may transmit or receive data through a wire or wireless network or a wire serial communication. Examples of the network may include the Internet, a local area network (LAN), a wireless LAN, a wide area network (WAN), and a personal area network (PAN). However, one or more exemplary embodiments are not limited thereto, and the network may be another type of network capable of transmitting and receiving information.

The communication interface unit 120 may search the hearing aid 300 and may connect the communication interface unit 120 to the searched hearing aid 300. The communication interface unit 120 may be connected to the hearing aid 300 by using a LAN technology. Examples of the LAN technology include Bluetooth, radio frequency identification (RFID), infrared data association (IrDA), ultra-wideband (UWB), ZigBee, or Wi-Fi Direct (WFD) near field communication (NFC), etc.

A setting unit 130 may set a received fitting parameter model into the hearing aid 300 connected to the setting unit 130 so that the hearing aid is configured to operate according to the fitting parameter model. Accordingly, the hearing aid 300 connected to the mobile terminal 100 may output a sound adjusted according to the set fitting parameter model.

The setting unit 130 may be at least one processor or may be included in the processor 140. Accordingly, the setting unit 130 and the processor 140 may operate as separate processors as illustrated in FIG. 3 or may operate as a single processor in a form in which the setting unit 130 is included in the processor 140.

The processor 140 controls the communication interface unit 120 to be operated according to a set fitting mode of the mobile terminal 100. Accordingly, when the received fitting mode is the manual mode, the processor 140 may determine to receive information about a recommended fitting parameter model of the hearing aid 300 from the server 200 in advance to receive a fitting parameter model from the server 200.

The processor 140 may control the communication interface unit 120 to be operated according to the on/off setting of an informing mode in the mobile terminal 100. Accordingly, the processor 140 may determine whether to receive information about a recommended fitting parameter model according to the setting of the informing mode.

The processor 140 may determine whether to automatically change the presently set fitting parameter model of the hearing aid 300 in an automatic fitting mode. In this regard, details are described with reference to FIGS. 8 through 11.

In addition, the processor 140 may control the overall operation of the mobile terminal 100. For example, the processor 140 performs the communication with the server 200, the control of the hearing aid 300, the control and processing related to data communication and voice calls. That is, the processor 140 may overall control the communication interface unit 120, the setting unit 130, the user interface unit 150, the memory 160, the situation information acquisition unit 170, and the movement information acquisition unit 180.

The user interface unit 150 may receive input information input by a user, and display output information processed in the mobile terminal 100 to the user. For example, the user interface unit 150 may include an input device such as a key pad, a dome switch, a pressure sensitive touch pad or capacitive touch pad, a jog wheel, a jog switch, or a hardware button, an output device such as a touch screen, a liquid crystal display, a thin film transistor-liquid crystal display, an organic light-emitting diode, a flexible display, or a three-dimensional display, and a software module for driving the input device and the output device. In addition, the user interface unit 150 may be implemented with a touch screen having a form in which an input device and an output device are combined with each other.

The user interface unit 150 may receive a fitting mode which is input from the user between a manual fitting mode and an automatic fitting mode. The user interface unit 150 may receive an informing mode which is input from the user between an informing on mode and an informing off mode.

The user interface unit 150 may display at least one fitting parameter model and receive a selection of the user of any one fitting parameter model from among the at least one fitting parameter model that is displayed.

The memory 160 is a general storage medium, and may store data such as fitting parameter models and hearing characteristics of a user and/or programs such as a fitting program for fitting a hearing aid and obtaining fitting parameter values of a hearing aid. The memory 160 may be implemented with a hard disk drive (HDD), a read only memory (ROM), a random access memory (RAM), a flash memory, a memory card, or a solid state drive (SSD).

The situation information acquisition unit 170 may acquire situation information from a user. The situation information may indicate information about the surroundings, occasion, and situation of the user. The situation information may be acquired through a microphone 172 or camera 171 of the mobile terminal 100, or may be transmitted to the mobile terminal 100 after being acquired through a microphone (not shown) on the hearing aid 300.

The camera 171 may acquire situation information from a user in a form of a still image or video. The camera 171 may include a photographing apparatus for capturing an image and an image sensor module for processing a captured image frame such as a still image or video.

The microphone 172 may acquire situation information from a user in a form of electrical voice data obtained by processing an external acoustic signal acquired by a microphone. The microphone 172 may include the microphone for acquiring an external sound as well as a digital signal processing module for removing noises and processing signals.

When acquiring the situation information from a user by using a microphone of the hearing aid 300, a sound obtained at the left side of the user and a sound obtained at the right side of the user may be separately obtained by using binaural hearing aids.

The movement information acquisition unit 180 may acquire movement information from a user. The movement information is information related to the movement of a user, such as a moving speed, a moving distance, and a moving direction of a user. The movement information may be acquired by an acceleration sensor 181 or a geomagnetic sensor 182 of the mobile terminal 100.

The acceleration sensor 181 may sense a movement state or a motional state of a user of the mobile terminal 100 by sensing a vibration or an impact applied to the mobile terminal 100 or a change in the speed of the mobile terminal 100.

The geomagnetic sensor 182 may recognize the movement or the location of an object by using geomagnetism.

Figure 4:
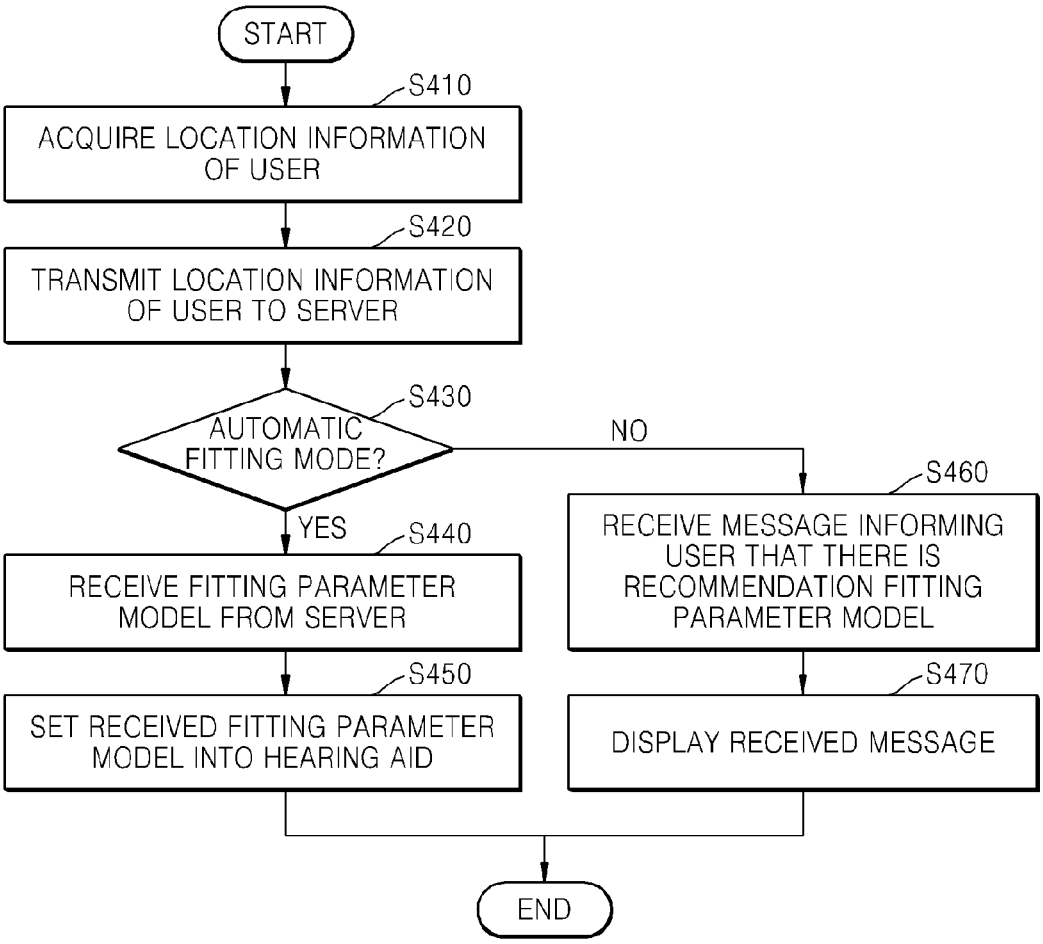
FIG. 4 is a flowchart illustrating a method of fitting a hearing aid by using a positioning system in a mobile terminal, according to an exemplary embodiment.

FIG. 4 is a flowchart illustrating a method of fitting a hearing aid by using a positioning system in a mobile terminal, according to an exemplary embodiment. The method illustrated in FIG. 4 includes operations that are time-sequentially processed in the mobile terminal 100 illustrated in FIGS. 1 through 3. Accordingly, although omitted below, details described above with respect to the mobile terminal 100 illustrated in FIGS. 1 through 3 may be applied to the method illustrated in FIG. 4.

In operation 410, the positioning system 110 acquires location information which is about the location of a user. The location information that is acquired by the positioning system 110 may have latitude, longitude, altitude, velocity, azimuth, etc. According to the current embodiment, the positioning system 110 may acquire the location information in a form of coordinates including the latitude, the longitude, and the altitude.

In operation 420, the communication interface unit 120 transmits the location information of the user to the server 200. The mobile terminal 100 may further transmit hearing characteristics of the user, situation information of the user, or movement information of the user other than the location information of the user to the server 200. In this regard, details are described with reference to FIGS. 8 through 11.

In operation 430, the processor 140 determines whether a fitting mode set into the mobile terminal 100 is an automatic fitting mode or a manual fitting mode. The fitting mode indicates whether to automatically change a fitting parameter model of the hearing aid 300 according to the location of the user. Accordingly, if the fitting mode set into the mobile terminal 100 is the automatic fitting mode, the method proceeds to operation 340. If the fitting mode set into the mobile terminal 100 is the manual fitting mode, the method proceeds to operation 370.

In operation 440, the communication interface unit 120 receives a fitting parameter model determined based on location information about the current location of the user and hearing characteristics of the user from the server 200. The server 200 may store fitting parameter models of the hearing aid 300, which are mapped to each location, along with the hearing characteristics. According to another exemplary embodiment, the server 200 may store the fitting parameter models along with situation information or satisfaction evaluation other than the hearing characteristics. In this regard, details are described with reference to FIGS. 8 through 20 below.

In operation 450, the setting unit 130 sets the fitting parameter model received by the communication interface unit 120 into the connected hearing aid 300.

In the automatic fitting mode, as described above, the fitting parameter model of the hearing aid 300 is automatically changed according to the location of the user.

In operation 460, the communication interface unit 120 receives a message informing the user that there is a recommended fitting parameter model, from the server 200.

In operation 470, the user interface unit 150 displays the received message.

In the manual fitting mode, the intervention of the user is required to set or change the fitting parameter model of the hearing aid 300.

Figure 5:
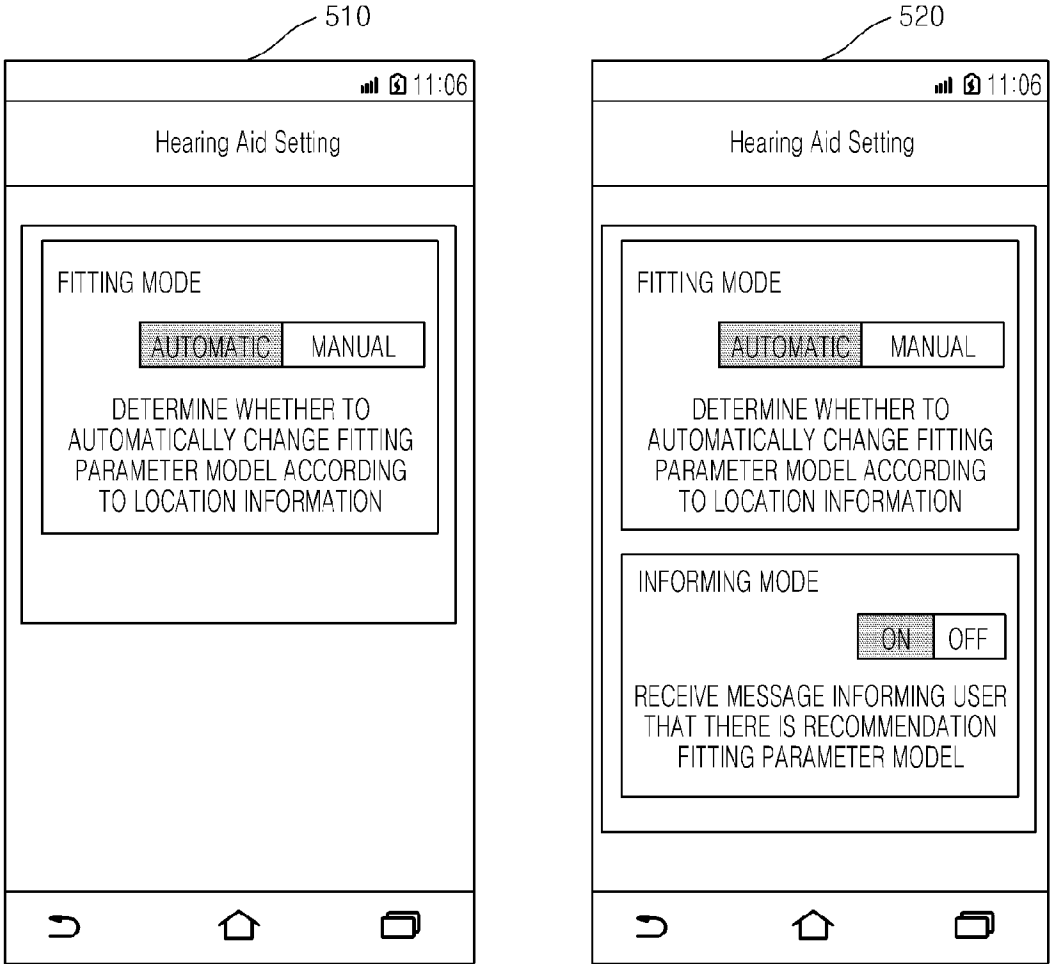
FIG. 5 is a diagram illustrating a screen for setting a fitting mode in a mobile terminal, according to an exemplary embodiment.

FIG. 5 is a diagram illustrating a screen for setting a fitting mode in a mobile terminal, according to an exemplary embodiment.

A screen 510 is an example of a user interface screen through which a user may set any one of the manual fitting mode and the automatic fitting mode of the hearing aid 300. The screen 510 shows a case in which the automatic fitting mode is set by the current user.

The fitting mode may indicate whether to automatically change a fitting parameter model of the hearing aid 300 according to the location of the user. That is, in the automatic fitting mode, the fitting parameter model is automatically changed according to the location information of the user. In the manual fitting mode, the user selects whether to change the fitting parameter model and personally selects a fitting parameter model to be changed.

In detail, in the automatic fitting mode, the mobile terminal 100 receives a fitting parameter model corresponding to location information of the user from the server 200 according to the location of the user and automatically sets the received fitting parameter model into the hearing aid 300, and thus, the fitting parameter model of the hearing aid 300 may be automatically changed according to the location of the user.

In the manual fitting mode, the user personally selects one of fitting parameter models, which is displayed by the mobile terminal 100, and requests the mobile terminal 100 to apply the selected fitting parameter model to the hearing aid 300. Then, a previously set fitting parameter model of the hearing aid 300 is replaced with the selected fitting parameter model. In the manual fitting mode, an informing on mode or an informing off mode may be further set.

The screen 520 is an example of a user interface screen in which a user may set any one of the informing "on" mode and the informing "off" mode in the manual fitting mode. The screen 520 shows a case in which the informing "on" mode of the manual fitting mode is set by the current user.

The informing mode indicates whether to receive a message, which informs the user that there is a recommended fitting parameter model corresponding to the location information of the user and hearing characteristics of the user, from the server 200. That is, in the informing "on" mode, according to the location of the user, the mobile terminal 100 receives the message informing the user that there is a recommended fitting parameter model corresponding to the location information of the user and the hearing characteristics of the user, and displays the received message.

In detail, in the informing "on" mode, the mobile terminal 100 receives information about the recommended fitting parameter model from the server 200, and the user may select one fitting parameter model based on the received information about the recommended fitting parameter model. In addition, the mobile terminal 100 may receive the fitting parameter model selected by the user and may set the received fitting parameter model into the hearing aid 300, and thus, a previously set fitting parameter model of the hearing aid 300 may be replaced with the fitting parameter model selected by the user.

In the informing "off" mode, without receiving a message or a fitting parameter model from the server 200, the user may select one of fitting parameter models previously stored in the memory 160 and sets the selected fitting parameter model into the hearing aid 300, and thus, a previously set fitting parameter model of the hearing aid 300 may be replaced with the selected fitting parameter model.

Figure 6A:
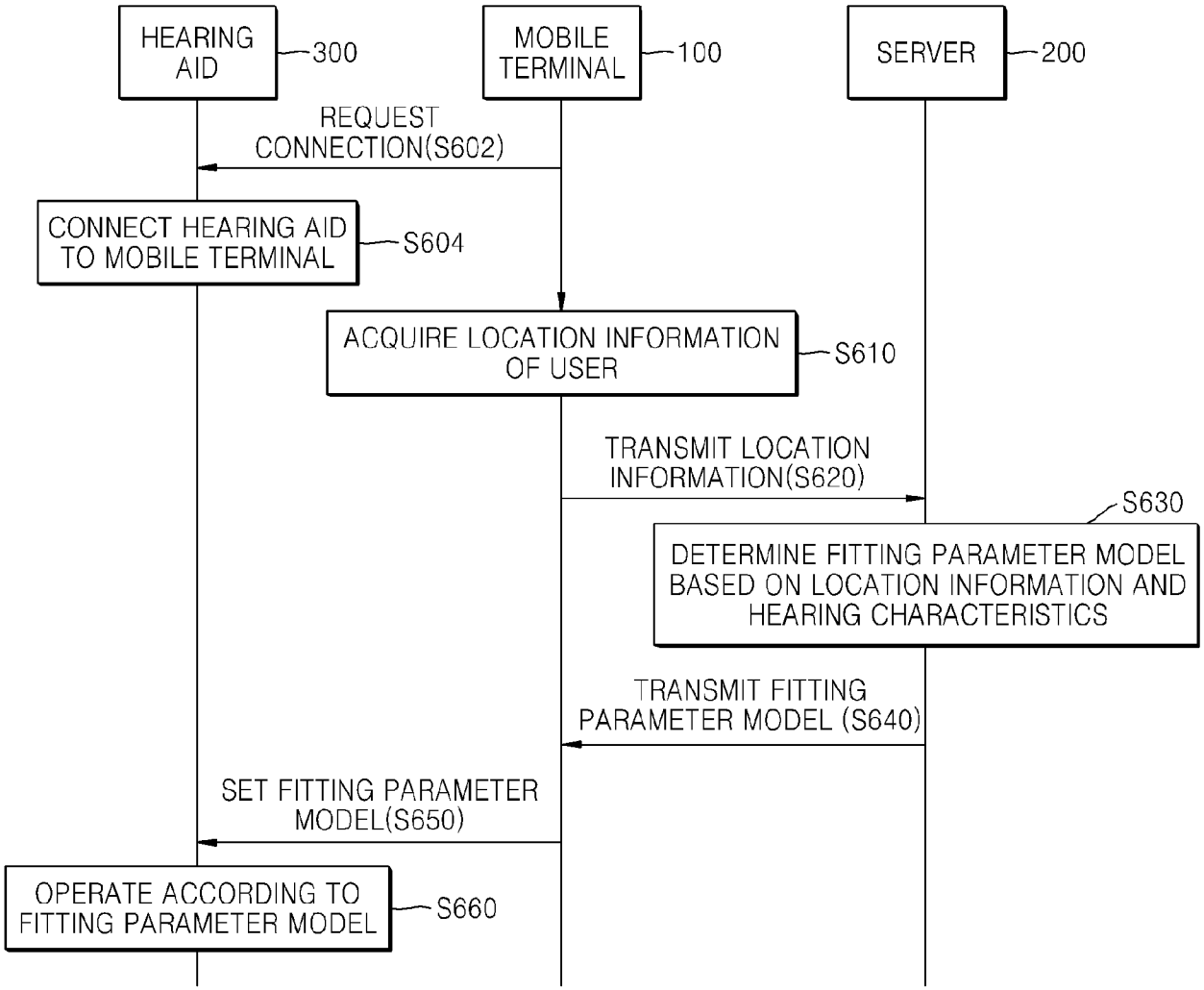
FIG. 6A is a flowchart illustrating a method of automatically fitting a hearing aid by using a positioning system in a mobile terminal, according to an exemplary embodiment.
Figure 6B:
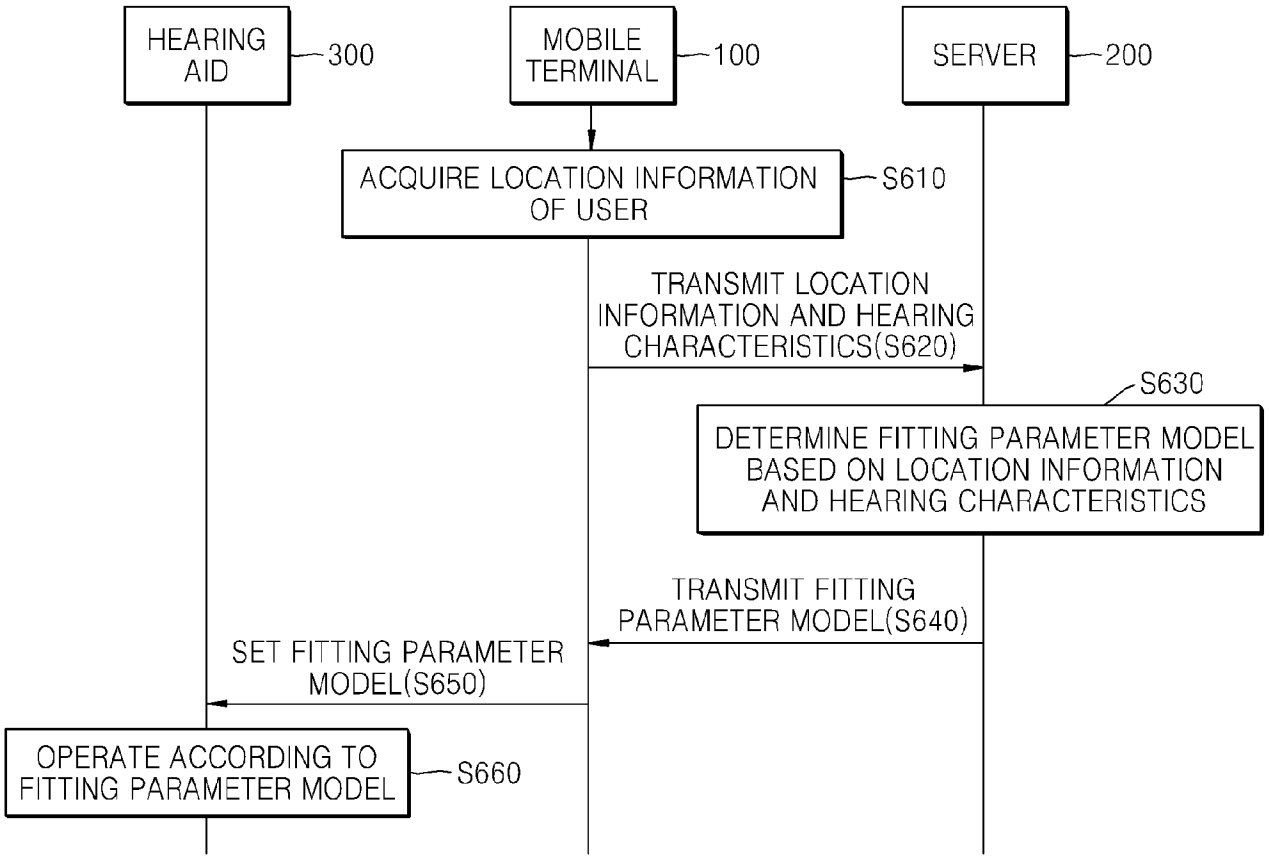
FIG. 6B is a flowchart illustrating a method of automatically fitting a hearing aid by using a positioning system in a mobile terminal, according to another exemplary embodiment.
Figure 6C:
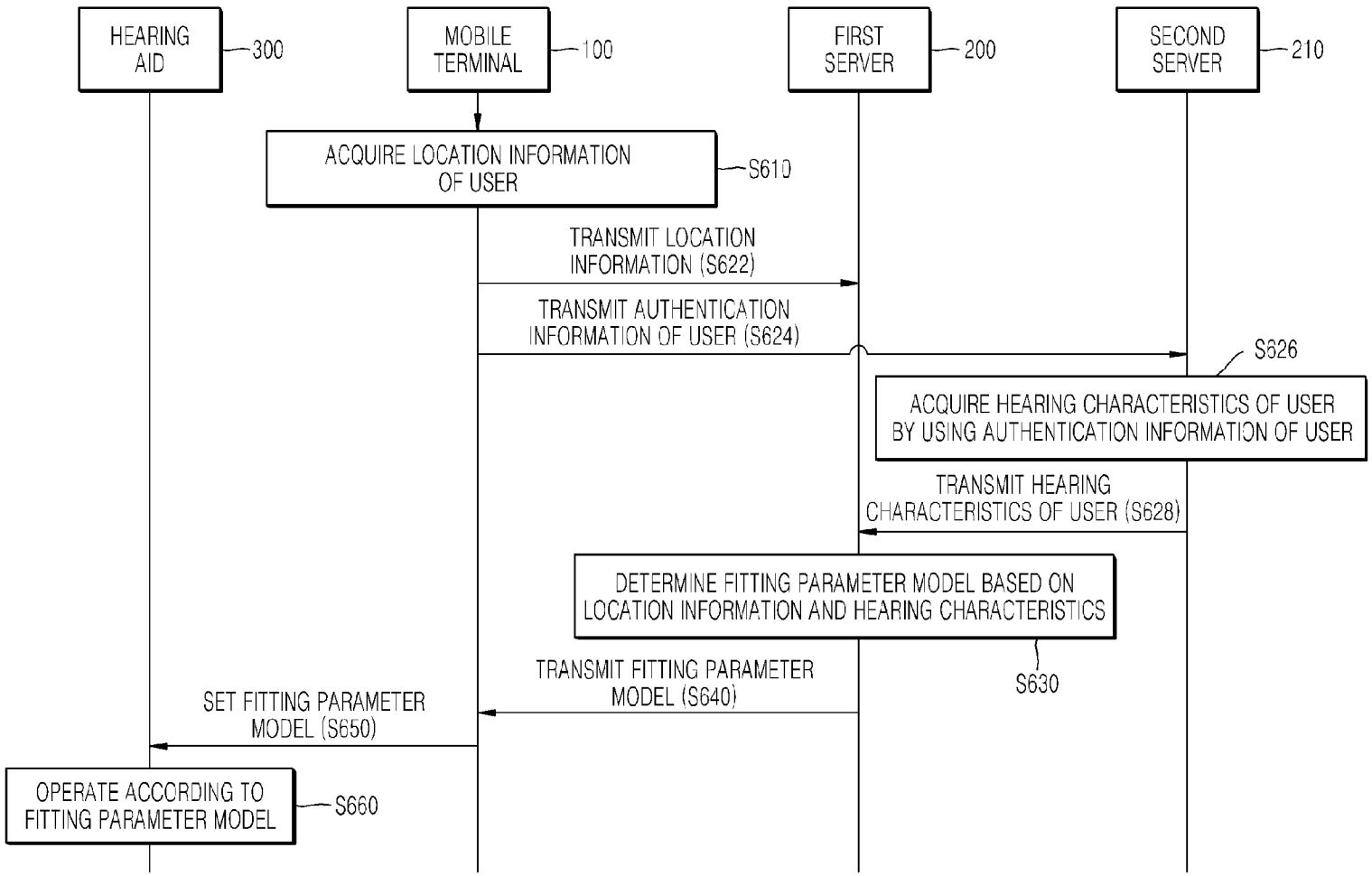
FIG. 6C is a flowchart illustrating a method of automatically fitting a hearing aid by using a positioning system in a mobile terminal, according to another exemplary embodiment

FIGS. 6A through 6C illustrate exemplary embodiments of methods that may be performed when the automatic fitting mode is set as shown in the flowchart illustrated in FIG. 4.

FIG. 6A is a flowchart illustrating a method of automatically fitting a hearing aid 300 by using a positioning system in a mobile terminal 100, according to an exemplary embodiment.

In operation 602, the mobile terminal 100 requests a connection from the hearing aid 300. In detail, the mobile terminal 100 may search for the hearing aid 300 and may request the searched hearing aid 300 to establish a connection to the mobile terminal 100.

In operation 604, the hearing aid 300 is connected to the mobile terminal 100. Thus, the hearing aid 300 may pair with the mobile terminal 100. The mobile terminal 100 may search for the hearing aid 300 by using a LAN technology such as Bluetooth and may be connected to the searched hearing aid 300.

If the mobile terminal 100 and the hearing aid 300 are connected to each other once, the connection state is maintained as far as no special situation such as a turning off of a power supply happens, and thus, the operations 602 and 604 may be performed in advance. Thus, the following exemplary embodiments are described under the assumption that the mobile terminal 100 and the hearing aid 300 were connected to each other.

In operation 610, the mobile terminal 100 acquires location information of a user by using the positioning system 110.

In operation 620, the mobile terminal 100 transmits the location information of the user to a server 200.

In operation 630, the server 200 determines a fitting parameter model based on the received location information of the user and hearing characteristics of the user. The server 200 may store fitting parameter models of the hearing aid 300, which are mapped to each location, along with hearing characteristics of the user in a form of database. The server 200 may determine a fitting parameter model more suitable for the user based on location information and hearing characteristics of the user, which are stored in the form of database.

The hearing characteristics of the user may be transmitted from the mobile terminal 100 to the server 200. An exemplary embodiment related to this is described with reference to FIG. 6B. Alternatively, the hearing characteristics of the user may be transmitted from a server (i.e., a second server) that is different from the server 200 to the server 200. An exemplary embodiment related to this is described with reference to FIG. 6C.

In operation 640, the server 200 transmits the determined fitting parameter model to the mobile terminal 100.

In operation 650, the mobile terminal 100 set the fitting parameter model received from the server 200 into the connected hearing aid 300.

In operation 660, the hearing aid 300 operates according to the set fitting parameter model. Accordingly, the hearing aid 300 may output a sound adjusted according to the set fitting parameter model.

FIG. 6B is a flowchart illustrating a method of automatically fitting a hearing aid 300 by using a positioning system in a mobile terminal 100, according to another exemplary embodiment. FIG. 6B illustrates a case in which the mobile terminal 100 transmits hearing characteristics of a user as well as location information of the user to a server 200.

In operation 610, the mobile terminal 100 acquires location information of a user by using the positioning system 110.

In operation 620, the mobile terminal 100 transmits the location information of the user and hearing characteristics of the user to the server 200.

In operation 630, the server 200 determines a fitting parameter model based on the received location information of the user and the received hearing characteristics of the user. The server 200 may store fitting parameter models of the hearing aid 300, which are mapped to each location, along with hearing characteristics of the user in a form of database. The server 200 may determine a fitting parameter model more suitable for the user based on location information and hearing characteristics of the user, which are stored in the form of database.

In operation 640, the server 200 transmits the determined fitting parameter model to the mobile terminal 100.

In operation 650, the mobile terminal 100 set the fitting parameter model received from the server 200 into the connected hearing aid 300.

In operation 660, the hearing aid 300 operates according to the set fitting parameter model. Accordingly, the hearing aid 300 may output a sound adjusted according to the set fitting parameter model.

FIG. 6C is a flowchart illustrating a method of automatically fitting a hearing aid 300 by using a positioning system in a mobile terminal 100, according to another exemplary embodiment. FIG. 6C illustrates a case in which the mobile terminal 100 transmits hearing characteristics of a user to a server 200, i.e., a first server, by using a second server 210 that is different from the first server 200.

In operation 610, the mobile terminal 100 acquires location information of a user by using the positioning system 110.

In operation 622, the mobile terminal 100 transmits the location information of the user to the first server 200.

In operation 624, the mobile terminal 100 transmits authentication information of the user to the second server 210. In the current exemplary embodiment, hearing characteristics of the user is not directly transmitted from the mobile terminal 100 to the first server 200, but is transmitted to the first server 200 via the second server 210.

In operation 626, the second server 210 acquires the hearing characteristics of the user by using the authentication information of the user. That is, the second server 210 receives the authentication information of the user, and acquires the hearing characteristics of the user based on the received authentication information of the user. The authentication information of the user may be an identification (ID) or password (PW) of the user, but is not limited thereto.

In operation 628, the second server 210 transmits the hearing characteristics of the user to the first server 200.

In operation 630, the first server 200 determines a fitting parameter model based on the received location information of the user and the received hearing characteristics of the user. The first server 200 may store fitting parameter models of the hearing aid 300, which are mapped to each location, along with hearing characteristics of the user in a form of database. The first server 200 may determine a fitting parameter model more suitable for the user based on location information and hearing characteristics of the user, which are stored in the form of database.

In operation 640, the first server 200 transmits the determined fitting parameter model to the mobile terminal 100.

In operation 650, the mobile terminal 100 may set the fitting parameter model received from the first server 200 into the connected hearing aid 300.

In operation 660, the hearing aid 300 operates according to the set fitting parameter model. Accordingly, the hearing aid 300 may output a sound adjusted according to the set fitting parameter model.

According to the current embodiment, the hearing characteristics of the user and the location information of the user are separately managed by two servers, that is, the first server 200 and the second server 210, thereby maintaining the privacy of the user.

Figure 7:
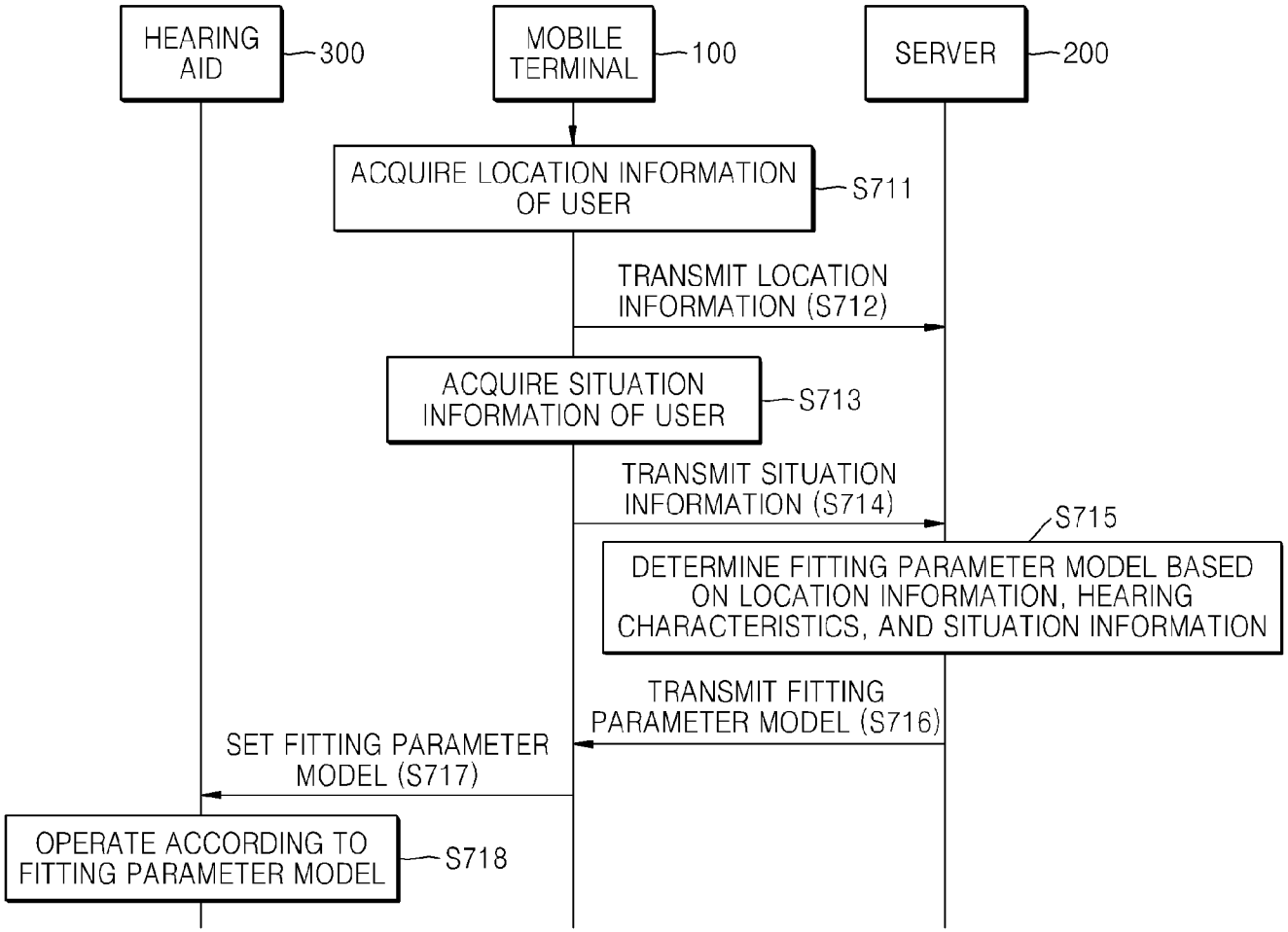
FIG. 7 is a flowchart illustrating a method of automatically fitting a hearing aid by using a positioning system in a mobile terminal, according to another exemplary embodiment.

FIG. 7 is a flowchart illustrating a method of automatically fitting a hearing aid 300 by using a positioning system in a mobile terminal 100, according to another exemplary embodiment. Comparing with the methods of FIGS. 6A through 6C, in the method of FIG. 7, the mobile terminal 100 additionally transmits situation information of a user to a server 200 and the server 200 provides a fitting parameter model determined by further referring to the situation information of the user.

In operation 711, the mobile terminal 100 acquires location information of a user by using the positioning system 110.

In operation 712, the mobile terminal 100 transmits the location information of the user to a server 200.

In operation 713, the mobile terminal 100 acquires situation information of the user. The situation information may indicate at least at least information about the surroundings, occasion, time, and situation of the user. The situation information may be acquired from a storage medium or through a sensor such as a microphone 172 or camera 171 of the mobile terminal 100, or may be transmitted to the mobile terminal 100 after being acquired through a microphone (not shown) of the hearing aid 300.

In operation 714, the mobile terminal 100 transmits the situation information of the user to a server 200.

In operation 715, the server 200 determines a fitting parameter model based on the location information of the user, the situation information of the user, and hearing characteristics of the user.

The server 200 may store fitting parameter models of the hearing aid 300, which are mapped to each location, along with the hearing characteristics of the user and the situation information of the user. Accordingly, the server 200 may provide a fitting parameter model more suitable for location characteristics, surroundings, and situation of the user by further referring to the situation information of the user.

For example, if a user sequentially listens to a musical performance and a lecture in the same little theater, situation information of the user is changed with a time interval while location information of the user is not changed.

For comparison, in the methods of FIGS. 6A through 6C, the mobile terminal 100 may transmit location information of a little theater to the server 200. The server 200 may determine one of fitting parameter models suitable for the hearing characteristics of the user from among fitting parameter models suitably fitted for location characteristics of the little theater according to the location information of the little theater, and may provide the determined fitting parameter model to the user. However, because characteristics of sounds that are generated in the musical performance are different from those that are generated in the lecture, fitting parameter models more suitable for respective situations may be different from each other.

On the other hand, in the method of FIG. 7, when the mobile terminal 100 acquires situation information of a user by using a microphone or a camera and transmits the acquired situation information to the server 200, the server 200 may provide a fitting parameter model more suitable for the current situation of the user to the user, even with respect to the same location information.

In operation 716, the server 200 transmits a determined fitting parameter model to the mobile terminal 100.

In operation 717, the mobile terminal 100 sets the fitting parameter model received from the server 200 into the hearing aid 300.

In operation 718, the hearing aid 300 operates according to the set fitting parameter model.

FIGS. 8 through 11 are flowcharts illustrating methods of determining whether the processor 140 automatically changes the currently set fitting parameter model of the hearing aid 300 in the automatic fitting mode of the mobile terminal 100 according to one or more exemplary embodiments. In the automatic fitting mode of the mobile terminal 100, a fitting parameter model of the hearing aid 300, which is set according to the location of a user, is automatically changed. However, according to another exemplary embodiment, there is a case in which it is not necessary to change the currently set fitting parameter model of the hearing aid 300. Thus, this case may be designated in advance and control of the fitting parameter model of the hearing aid 300 may be controlled so that the fitting parameter is not to be automatically changed. Detailed exemplary embodiments related to this case are described with reference to FIGS. 8 through 11.

Figure 8:
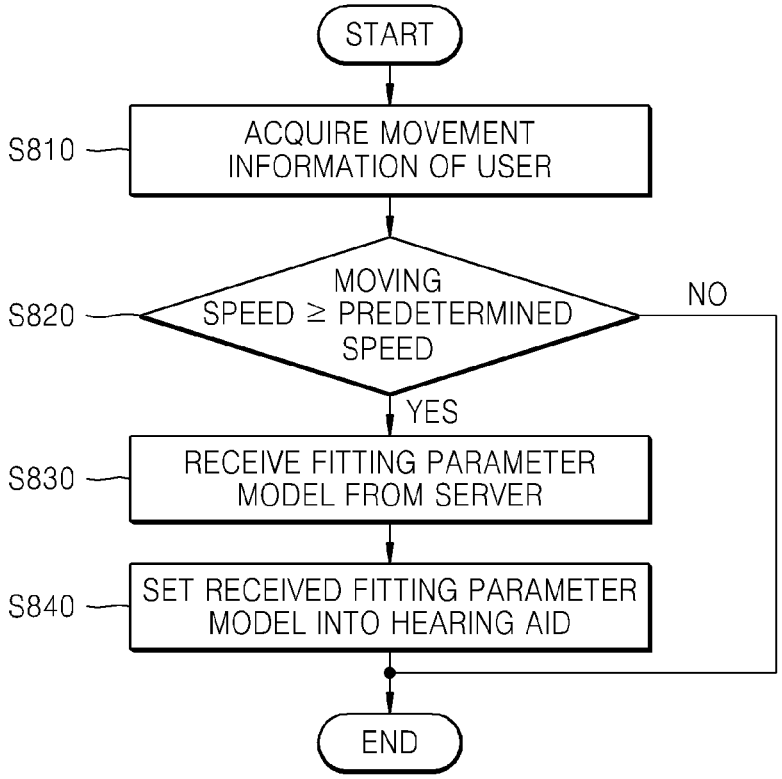
FIG. 8 is a flowchart illustrating a method of determining whether to change the currently set fitting parameter model of a hearing aid based on movement information of a user in an automatic fitting mode of a mobile terminal, according to an exemplary embodiment.

FIG. 8 is a flowchart illustrating a method of determining whether to change the currently set fitting parameter model of the hearing aid 300 based on movement information of a user in the automatic fitting mode of the mobile terminal 100, according to an exemplary embodiment. Operations 830 and 840 illustrated in FIG. 8 are similar to operations 440 and 450 illustrated in FIG. 4, and thus, descriptions thereof are not repeated.

In operation 810, the movement information acquisition unit 180 acquires movement information of a user. The movement information is information related to the movement of a user, such as a moving speed, a moving distance, and a moving direction of a user. The movement information may be acquired by the acceleration sensor 181, the geomagnetic sensor 182, or the positioning system 110 of the mobile terminal 100.

In operation 820, the processor 140 determines whether to change the currently set fitting parameter model of the hearing aid 300 based on the movement information of the user in the automatic fitting mode of the mobile terminal 100. If the processor 140 determines to change the currently set fitting parameter model based on the movement information of the user, the method proceeds to operation 830. If the processor 140 determines not to change the currently set fitting parameter model, the processor 140 controls the hearing aid 300 so as to maintain the fitting parameter model currently set into hearing aid 300.

For example, the processor 140 may determine not to change the currently set fitting parameter model of the hearing aid 300 based on a moving distance or a moving speed of a user. Detailed embodiments related to this case are described with reference to FIGS. 9 and 10.

In operation 830, the communication interface unit 120 receives a fitting parameter model, which corresponds to current location information of the user and hearing characteristics of the user, from the server 200.

In operation 840, the setting unit 130 sets the fitting parameter model received by the communication interface unit 120 into the connected hearing aid 300.

Figure 9:
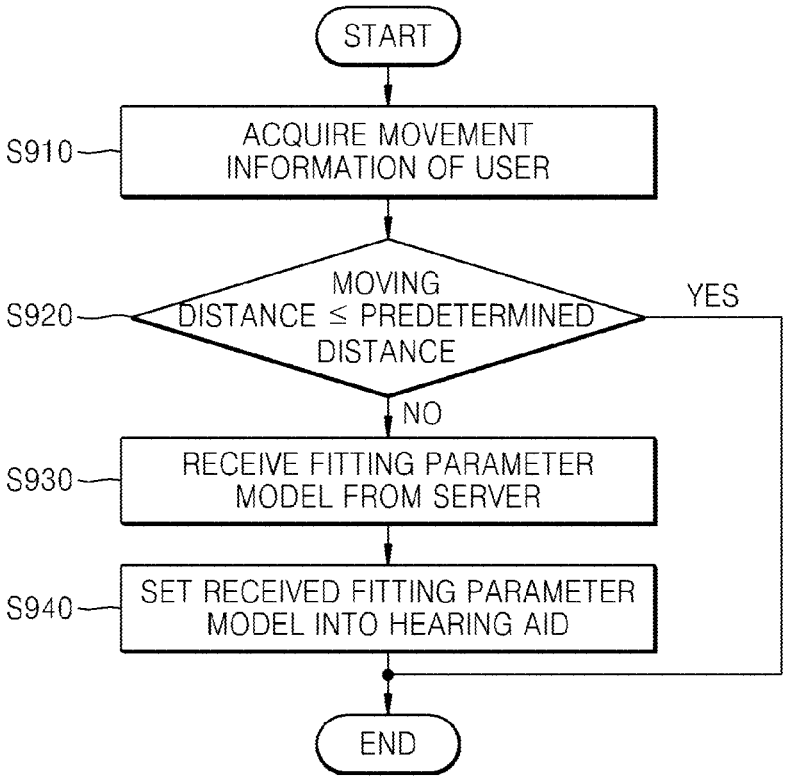
FIG. 9 is a flowchart illustrating a method of determining whether to change the currently set fitting parameter model of a hearing aid based on movement information of a user in an automatic fitting mode of a mobile terminal, according to another exemplary embodiment.

FIG. 9 is a flowchart illustrating a method of determining whether to change the currently set fitting parameter model of the hearing aid 300 based on movement information of a user in the automatic fitting mode of the mobile terminal 100, according to another exemplary embodiment. Operations 930 and 940 illustrated in FIG. 9 are similar to operations 440 and 450 illustrated in FIG. 4, and thus, descriptions thereof are not repeated.

In operation 910, the movement information acquisition unit 180 acquires movement information of a user. In this case, the acquired movement information includes a moving distance of the user.

In operation 920, the processor 140 determines whether to change the currently set fitting parameter model of the hearing aid 300 based on the moving distance of the user in the automatic fitting mode. In this case, if the moving distance is equal to or less than a predetermined distance, it is determined that the currently set fitting parameter model needs not to be changed.

That is, if moving distances of the user are relatively not long, fitting parameter models corresponding to location information of the user are the same as or very similar to each other. Thus, the mobile terminal 100 needs not to receive a new fitting parameter model from the server 200 and needs not to reset the hearing aid 300. Accordingly, the processor 140 controls the hearing aid 300 so as to maintain the fitting parameter model currently set into the hearing aid 300.

On the contrary, if a moving distance of the user exceeds a predetermined distance, it is determined that the currently set fitting parameter model of the hearing aid 300 needs to be changed. Accordingly, the method proceeds to operation 930.

In operation 930, the communication interface unit 120 may receive a fitting parameter model, which corresponds to current location information of the user and hearing characteristics of the user, from the server 200.

In operation 940, the setting unit 130 may set the fitting parameter model received by the communication interface unit 120 into the connected hearing aid 300.

Figure 10:
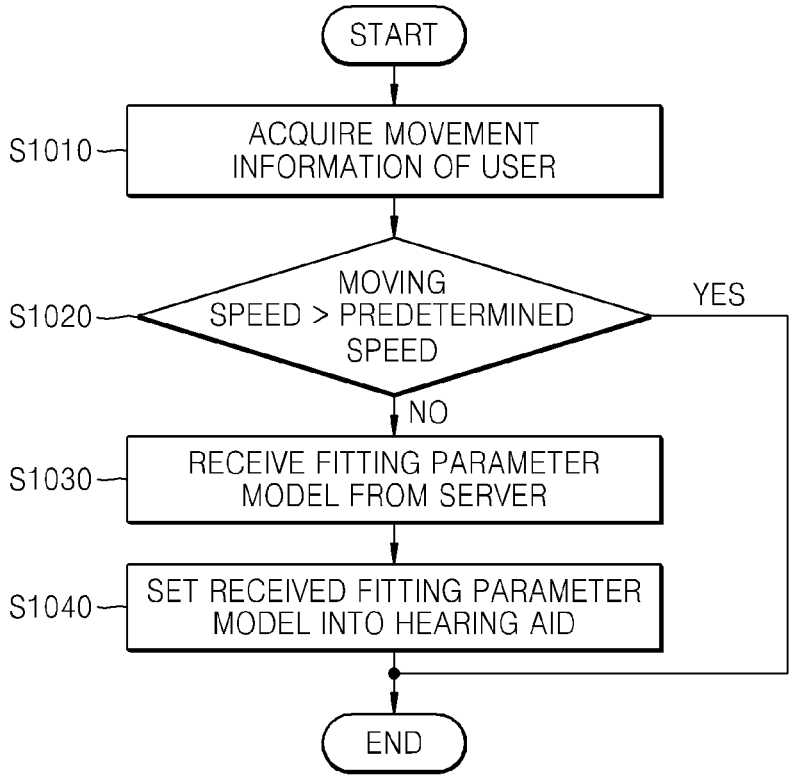
FIG. 10 is a flowchart illustrating a method of determining whether to change the currently set fitting parameter model of a hearing aid based on movement information of a user in an automatic fitting mode of a mobile terminal, according to another exemplary embodiment.

FIG. 10 is a flowchart illustrating a method of determining whether to change the currently set fitting parameter model of the hearing aid 300 based on movement information of a user in the automatic fitting mode of the mobile terminal 100, according to another exemplary embodiment. Operations 1030 and 1040 illustrated in FIG. 10 are similar to operations 440 and 450 illustrated in FIG. 4, and thus, descriptions thereof are not repeated.

In operation 1010, the movement information acquisition unit 180 acquires movement information of a user. In this case, the acquired movement information includes a moving speed of the user.

In operation 1020, the processor 140 determines whether to change the currently set fitting parameter model of the hearing aid 300 based on the moving speed of the user in the automatic fitting mode. In this case, if the moving speed is equal to or greater than a predetermined speed, it is determined that the currently set fitting parameter model needs not to be changed.

If the moving speed of the user is very fast, for example, the user is moving with a vehicle, acquired location information of the user corresponds to a point by which the user passes. Thus, the mobile terminal 100 may not need to receive a new fitting parameter model from the server 200 and may not need to reset the hearing aid 300. Accordingly, the processor 140 controls the hearing aid 300 so as to maintain the fitting parameter model currently set into the hearing aid 300.

If a moving speed of the user is less than a predetermined speed, it is determined that the currently set fitting parameter model of the hearing aid 300 needs to be changed. Accordingly, the method proceeds to operation 1030.

In operation 1030, the communication interface unit 120 receives a fitting parameter model, which corresponds to current location information of the user and hearing characteristics of the user, from the server 200.

In operation 1040, the setting unit 130 sets the fitting parameter model received by the communication interface unit 120 into the connected hearing aid 300.

Figure 11:
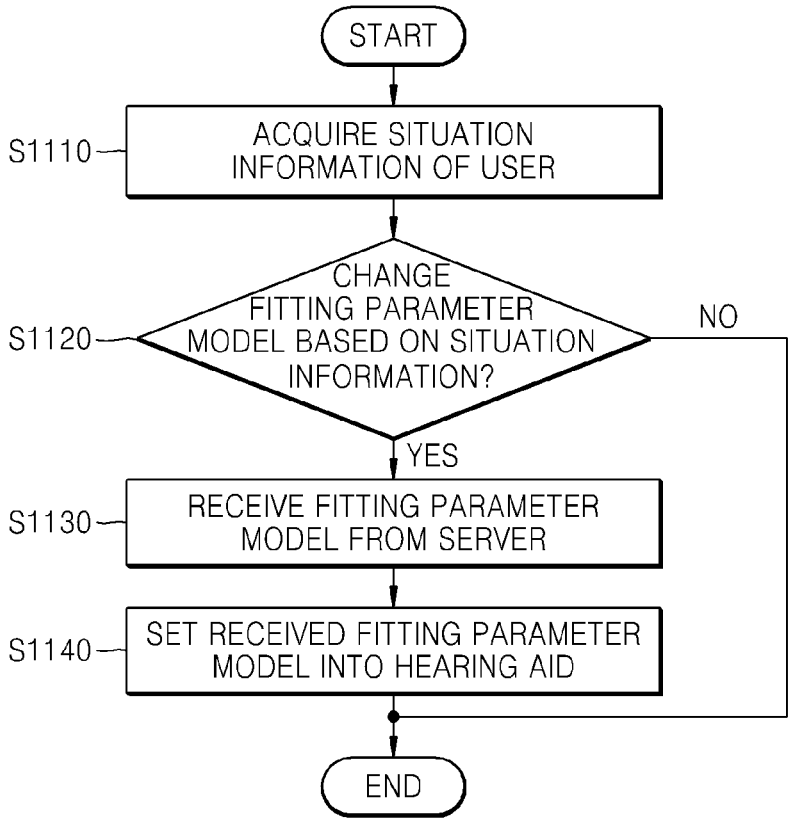
FIG. 11 is a flowchart illustrating a method of determining whether to change the currently set fitting parameter model of a hearing aid based on situation information of a user in an automatic fitting mode of a mobile terminal, according to another exemplary embodiment.

FIG. 11 is a flowchart illustrating a method of determining whether to change the currently set fitting parameter model of the hearing aid 300 based on situation information of a user in the automatic fitting mode of the mobile terminal 100, according to another exemplary embodiment. Operations 1130 and 1140 illustrated in FIG. 11 are similar to operations 440 and 450 illustrated in FIG. 4, and thus, descriptions thereof are not repeated.

In operation 1110, the situation information acquisition unit 170 acquires situation information of a user. In this case, the situation information may indicate information about the surroundings, occasion, time, and situation of the user, which are determined based on a sound or scene around the user when fitting the hearing aid 300. The situation information may be acquired through the microphone of the hearing aid 300 and the microphone 172 or the camera 117 of the mobile terminal 100.

In operation 1120, the processor 140 determines whether to change the currently set fitting parameter model of the hearing aid 300 based on the situation information of the user in the automatic fitting mode of the mobile terminal 100. If it is determined that the processor 140 needs to change the currently set fitting parameter model based on the situation information of the user, the method proceeds to operation 1130. If it is determined that the processor 140 does not need to change the currently set fitting parameter model, the processor 140 controls the hearing aid 300 so as to maintain the fitting parameter model currently set into hearing aid 300.

For example, the processor 140 may determine not to change the currently set fitting parameter model of the hearing aid 300 if it is determined that the user is on the phone or is exercising, based on the situation information of the user.

In operation 1130, the communication interface unit 120 receives a fitting parameter model, which corresponds to current location information of the user and hearing characteristics of the user, from the server 200.

In operation 1140, the setting unit 130 sets the fitting parameter model received by the communication interface unit 120 into the connected hearing aid 300.

Figure 12:
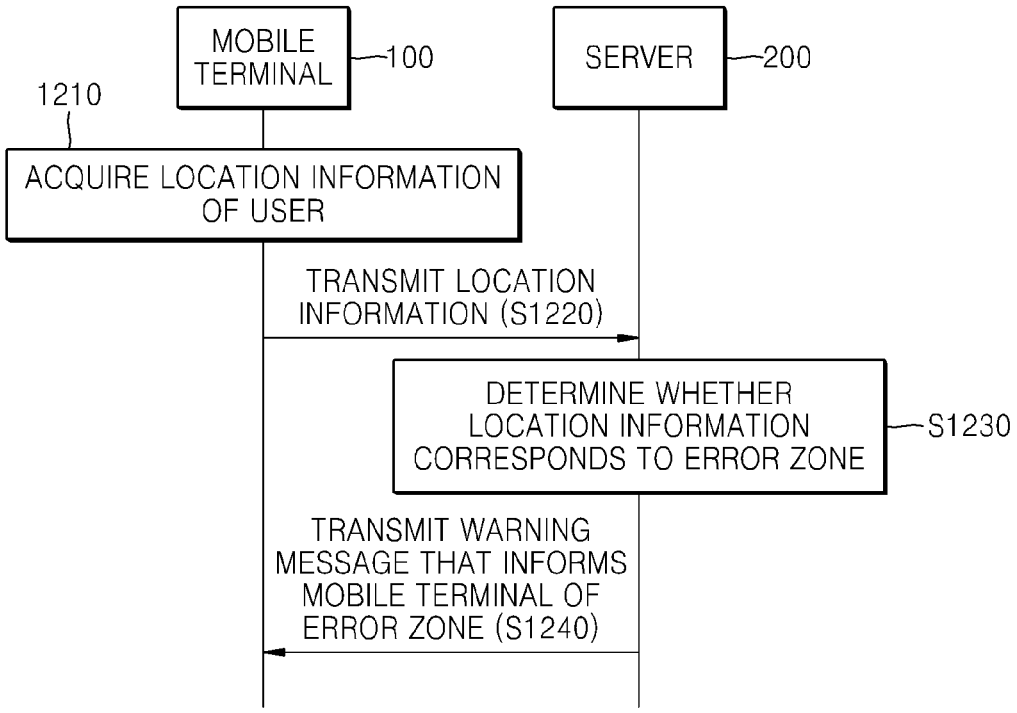
FIG. 12 is a flowchart illustrating a method of informing a user of a hearing aid of an error zone by using a positioning system in a mobile terminal, according to an exemplary embodiment.

Although in the current exemplary embodiment, determining whether to change the currently set fitting parameter model of the hearing aid 300 based on only the situation information of the user in the automatic fitting mode is described, the processor 140 may determine whether to change the currently set fitting parameter model of the hearing aid 300 in consideration of both of the situation information of the user and the movement information of the user FIG. 12 is a flowchart illustrating a method of informing a user of a hearing aid of an error zone by using a positioning system in a mobile terminal 100, according to an exemplary embodiment. Operations 1210 and 1220 illustrated in FIG. 12 are similar to operations 711 and 712 illustrated in FIG. 7, and thus, descriptions thereof are not repeated.

In operation 1210, the mobile terminal 100 acquires location information of a user by using the positioning system 110.

In operation 1220, the mobile terminal 100 transmits the location information of the user to a server 200.

In operation 1230, the server 200 determines whether the location information of the user corresponds to an error zone registered in the server 200. The error zone is a zone where an abnormality of the hearing aid has occurred. The server 200 stores records about the occurrence of the abnormality of the hearing aid with respect to each location, and registers error zones based on the records.

In operation 1240, if the server 200 determines that the location information of the user corresponds to an error zone registered in the server 200, the server 200 transmits a warning message, which informs the mobile terminal 100 of the error zone, to the mobile terminal 100. Accordingly, because the user may perceive, in advance, that the location of the user is the error zone, a risk that may occur due to the abnormality of the hearing aid may be prevented beforehand.

Figure 13:
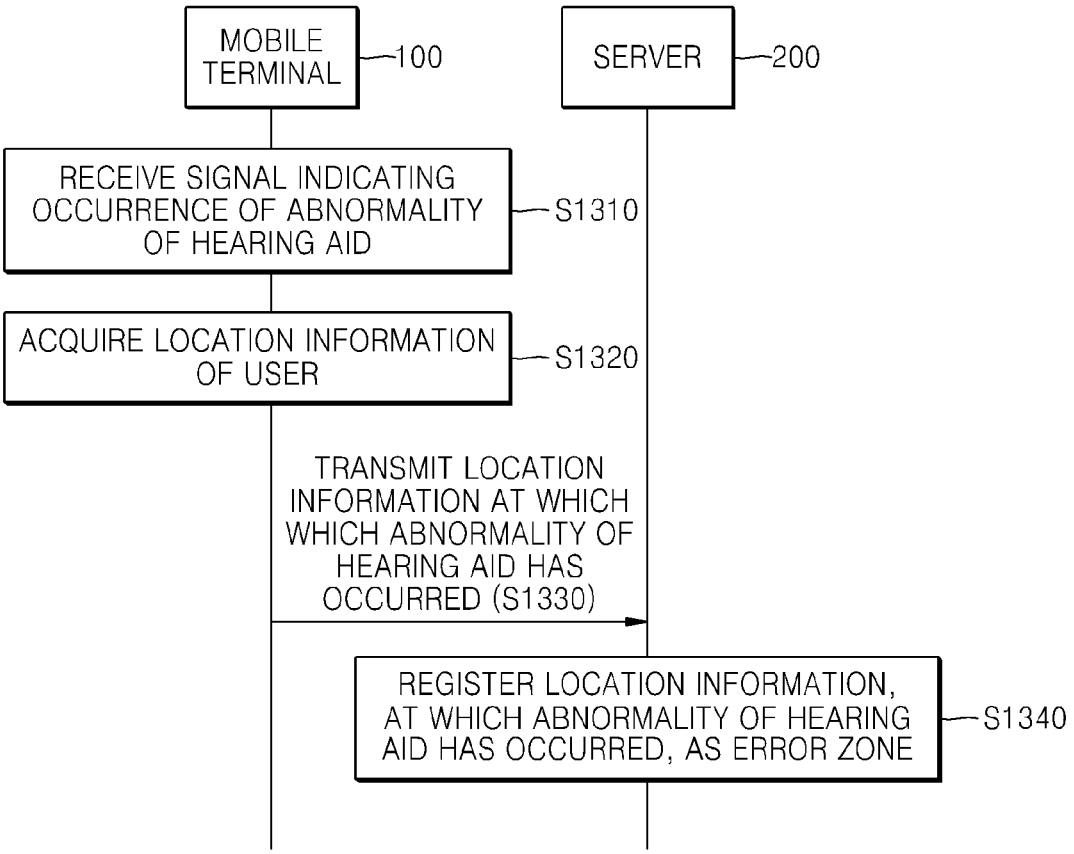
FIG. 13 is a flowchart illustrating a method of registering an error zone, in which an abnormality of a hearing aid has occurred, into a server by using a positioning system in a mobile terminal, according to an exemplary embodiment.

FIG. 13 is a flowchart illustrating a method of registering an error zone, in which an abnormality of the hearing aid 300 has occurred, at a server 200 by using a positioning system in a mobile terminal 100, according to an exemplary embodiment.

In operation 1310, the mobile terminal 100 receives a signal indicating the occurrence of an abnormality of the hearing aid 300. That is, a user perceives that an abnormality of the hearing aid 300 has occurred and inputs a signal indicating the occurrence of the abnormality through the user interface unit 150. The abnormality of the hearing aid 300 indicates that the hearing aid 300 does not normally operate due to jamming or the like.

In operation 1320, the mobile terminal 100 acquires location information about a location, at which the abnormality of the hearing aid 300 has occurred, by using a positioning system 110.

In operation 1330, the mobile terminal 100 transmits the location information to the server 200.

In operation 1340, the server 200 registers the location, in which the abnormality of the hearing aid 300 has occurred, as an error zone. The server 200 may collect location information about the location of a place, in which an abnormality of the hearing aid 300 has occurred, from the user, may compile statistics of the location information, and then may register the place as an error zone if it is statistically determined that the abnormality of the hearing aid 300 is not a temporary abnormality.

In this manner, location information about an abnormality of the hearing aid 300, which occurs due to location characteristics of a location, may be registered into the server 200 in advance by using the positioning system 110 and the user may be informed of the location information, and thus, a risk that may be encountered by a user may be prevented beforehand.

Figure 14:
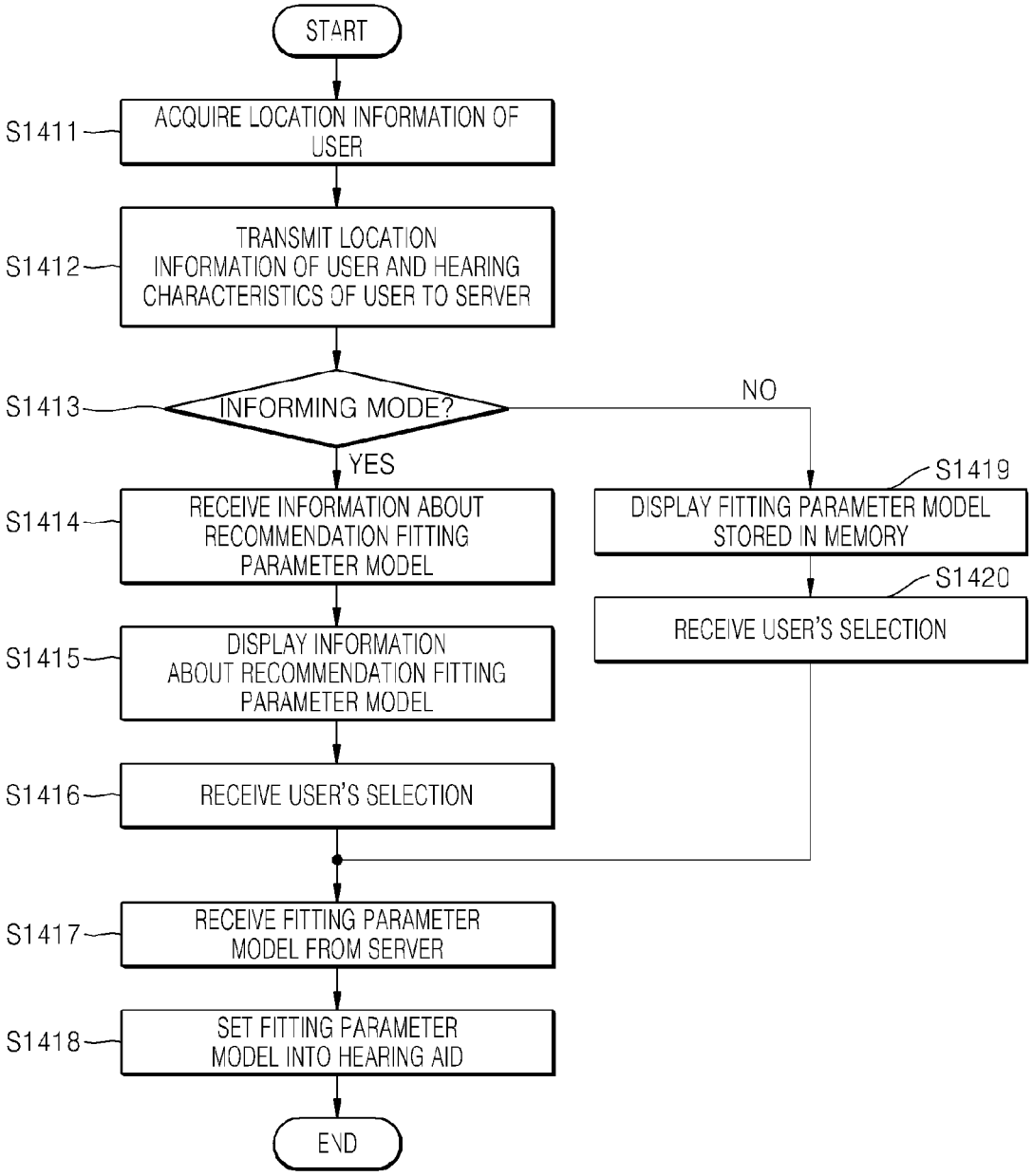
FIG. 14 is a flowchart illustrating a method of manually fitting a hearing aid by using a positioning system in a mobile terminal, according to another exemplary embodiment.

FIG. 14 is a flowchart illustrating a method of manually fitting a hearing aid by using a positioning system in a mobile terminal, according to another exemplary embodiment. Operations 1411 and 1412 illustrated in FIG. 14 are similar to operations 410 and 420 illustrated in FIG. 4, and thus, descriptions thereof are not repeated.

In operation 1411, the positioning system 110 acquires location information of a user.

In operation 1412, the communication interface unit 120 transmits the location information of the user to the server 200.

In operation 1413, the processor 140 determines whether an informing mode set by the user in a manual fitting mode is turned on or off. If the informing mode set in the mobile terminal 100 is on, the method proceeds to operation 1414. If the informing mode set in the mobile terminal 100 is off, the method proceeds to operation 1419.

In operation 1414, the communication interface unit 120 receives information about a recommended fitting parameter model from the server 200. The recommended fitting parameter model is at least one fitting parameter model corresponding to hearing characteristics of a user from among fitting parameter models mapped to the location of the user. The information about the recommended fitting parameter model includes simple information related to the recommended fitting parameter model. The information about the recommended fitting parameter model may be a message informing a user that there is at least one recommended fitting parameter model corresponding to location information of a user and hearing characteristics of the user. The information about the recommended fitting parameter model may include the evaluation of user satisfaction with a fitting parameter model. In this regard, details are described with reference to FIG. 20.

In operation 1415, the user interface unit 150 displays the information about the recommended fitting parameter model received from the server 200. In this regard, details are described with reference to a screen 1520 of FIG. 20.

In operation 1416, the user interface unit 150 receives a selection of the user. The user may select any one of displayed fitting parameter models, and inputs the selection of the user to the user interface unit 150.

In operation 1417, the communication interface unit 120 receives a fitting parameter model selected by the user from the server 200.

In operation 1418, the setting unit 130 sets the received fitting parameter model into the hearing aid 300.

In a manual fitting mode in which the informing mode is turned on, the mobile terminal 100 receives information about recommended fitting parameter model from the server 200, selects one of recommended fitting parameter models based on the received information, and then receives the selected fitting parameter model from the server 200.

Below operations are operations that are performed in a manual fitting mode in which the informing mode is turned off.

In operations 1419, the user interface unit 150 displays a fitting parameter model stored in the memory 160. In this regard, details are described with reference to a screen 1510 of FIG. 15.

In operation 1420, the communication interface unit 120 receives a selection of the user. The user selects any one of displayed fitting parameter models, and inputs the selection of the user to the user interface unit 150. If the selection of the user is input to the user interface unit 150, the method proceeds to operation 1417 and the selected fitting parameter model is set into the hearing aid 300.

In this manner, if the informing mode is turned off, the mobile terminal 100 does not receive information about a recommended fitting parameter model from the server 200 and sets the hearing aid 300 by using a fitting parameter model stored in the memory 160.

Figure 15:
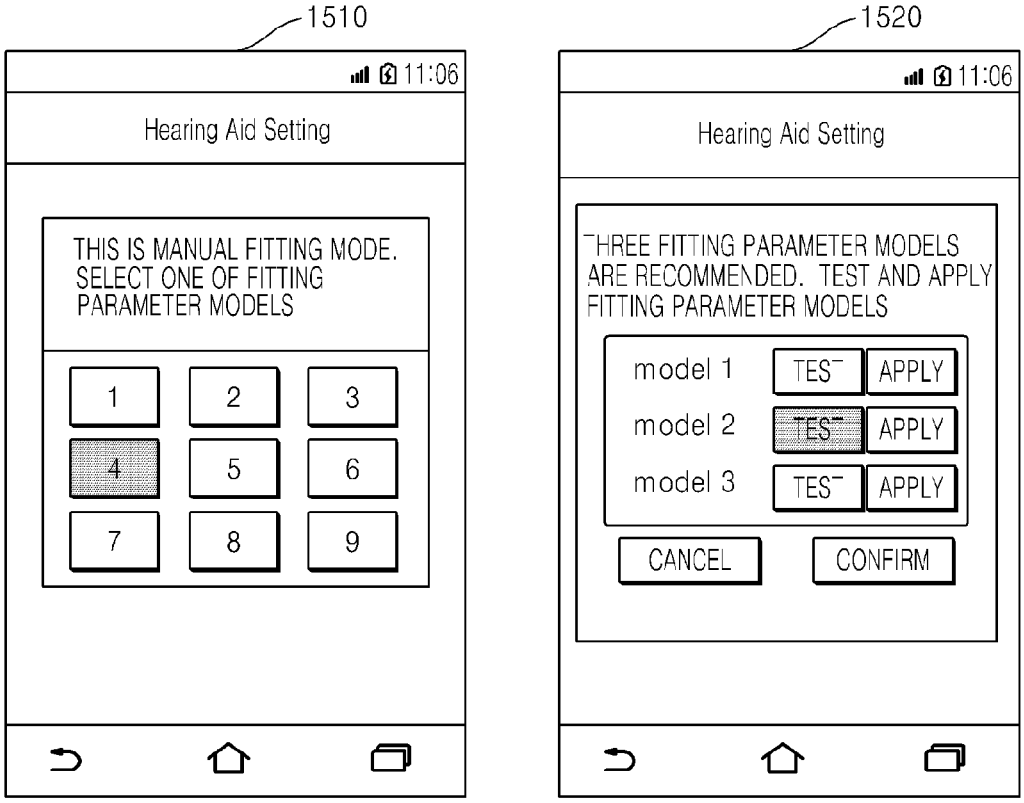
FIG. 15 illustrates screens for setting a fitting parameter model in a manual fitting mode of a mobile terminal, according to an exemplary embodiment.

FIG. 15 illustrates screens 1510 and 1520 for setting a fitting parameter model in a manual fitting mode of the mobile terminal 100, according to an exemplary embodiment.

The screen 1510 illustrates an example in which the mobile terminal 100 may provide a fitting parameter model when turning off an informing mode indicating that there is a recommended fitting parameter model, in the manual fitting mode.

When a fitting mode set by a user in the mobile terminal 100 is the manual fitting mode, the processor 140 determines not to receive a fitting parameter model from the server 200. In addition, in the manual fitting mode of the mobile terminal, when the user turns off the informing mode, the processor 140 determines not to receive information about a recommended fitting parameter model from the server 200.

When the informing mode is turned off in the manual fitting mode of the mobile terminal 100, the mobile terminal 100 displays a fitting parameter model stored in the memory 160 through the user interface unit 150. Fitting parameter models stored in the memory 160 may be displayed as shown in the screen 1510. For example, if the number of fitting parameter models stored in the memory 160 is nine, the mobile terminal 100 may display the fitting parameter models by using respective corresponding numbers as shown in the screen 1510.

The mobile terminal 100 may receive any one of the fitting parameter models stored in the memory 160 from the user through the user interface unit 150. For example, the user may select a number of a fitting parameter model which the user desires to set from among nine numbers displayed on the screen 1510, and may input the selected number through the user interface 150.

When a fitting parameter model is input, that is, a selected number is input, the setting unit 130 of the mobile terminal 100 sets the input fitting parameter model into the hearing aid 300 connected to the mobile terminal 100. In this manner, the mobile terminal 100 may easily fit the hearing aid 100 with a desired fitting model.

The screen 1520 illustrates an example in which the mobile terminal 100 receives information about a recommended fitting parameter model from the server 200 when turning on the informing mode in the manual fitting mode.

When a fitting mode set by a user in the mobile terminal 100 is the manual fitting mode, the processor 140 receives a fitting parameter model from the server 200 and determines not to automatically set the fitting parameter model into the hearing aid 300. In this case, when the user turns on the informing mode, the processor 140 determines to receive information about at least one recommended fitting parameter model from the server 200.

When the informing mode is turned on in the manual fitting mode of the mobile terminal 100, the mobile terminal 100 receives information about a recommended fitting parameter model, which corresponds to location information of the user and hearing characteristics of the user, from the server 200 through the communication interface unit 120.

The user interface unit 150 displays the received information about the recommended fitting parameter model. The information about the recommended fitting parameter model may be displayed as shown in the screen 1520. For example, when the number of recommended fitting parameter models searched in the server 200 is three, the mobile terminal 100 may show that there are three recommended parameter models, as shown in the screen 1520.

In this case, the mobile terminal 100 does not receive recommended fitting parameter models, and rather receives information about a recommended fitting parameter model. Unlike the automatic fitting mode, in the manual fitting mode, as the user inputs any one of recommended fitting parameter models displayed through the user interface unit 150, the mobile terminal 100 may receive a fitting parameter model from the server 200. For example, by selecting "application" with respect to one of the recommended fitting parameter models, the mobile terminal 100 receive a selected fitting parameter model from the server 200.

As illustrated in the screen 1520, the user may be provided with a test sound of a recommended fitting parameter model from the server 200. In this regard, details are described with reference to FIG. 19.

When a fitting parameter model is received from the server 200, the setting unit 130 of the mobile terminal 100 sets the received fitting parameter model into the hearing aid 300 connected to the mobile terminal 100. In this manner, the mobile terminal 100 may easily set the hearing aid 100 with a desired fitting model.

Figure 16:
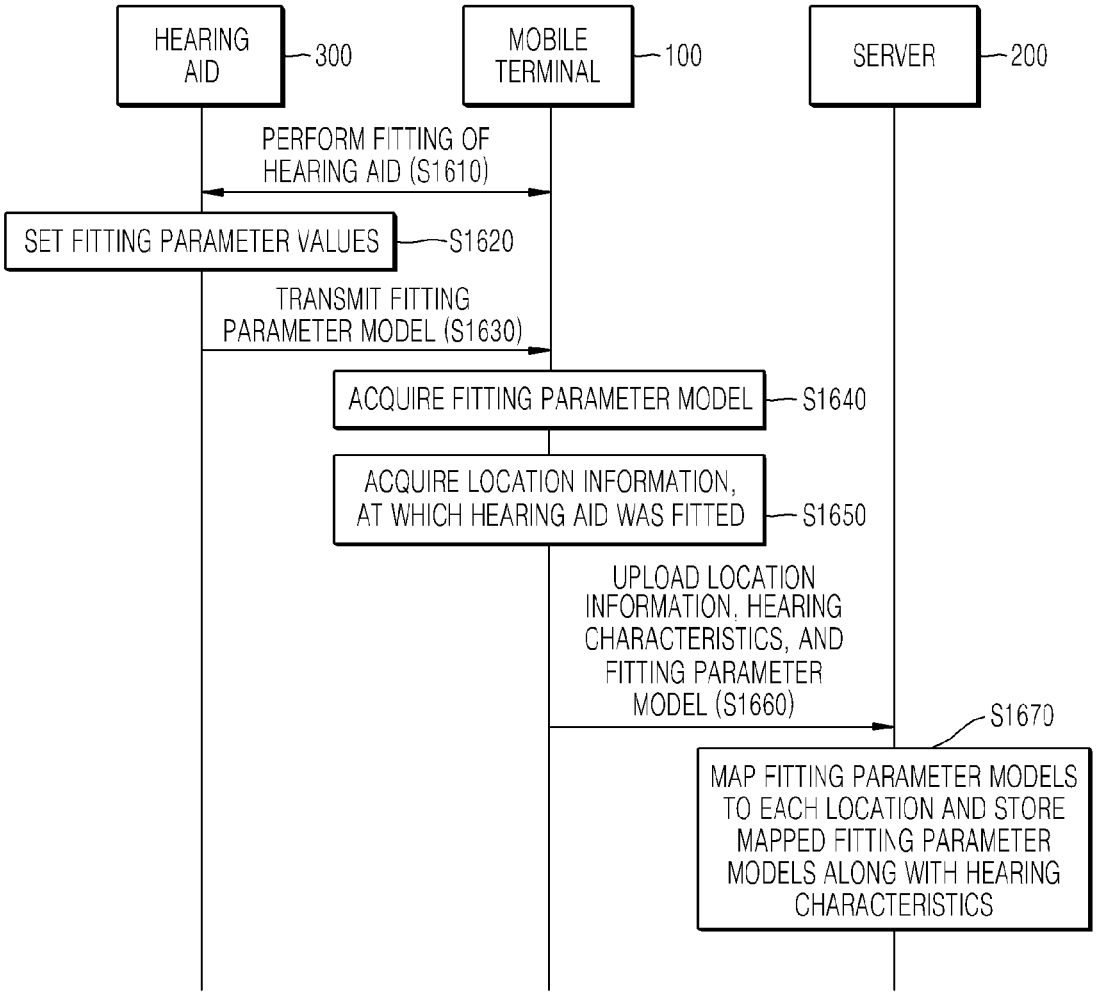
FIG. 16 is a flowchart illustrating a method of fitting a hearing aid and uploading a fitted fitting parameter model in association with location information to a server, in a mobile terminal, according to an exemplary embodiment.

FIG. 16 is a flowchart illustrating a method of fitting a hearing aid 300 and uploading a fitted fitting parameter model along with location information to a server 200, in a mobile terminal 100, according to an exemplary embodiment.

In operation 1610, the fitting of the hearing aid 300 is performed to be suitable for hearing characteristics of a user at a location by using the mobile terminal 100. For example, the fitting of the hearing aid 300 may be performed by using a fitting program for fitting a hearing aid and obtaining fitting parameter values of the hearing aid 300 to be suitable for hearing characteristics of the user at the location, which is stored in the mobile terminal 100. However, one or more exemplary embodiments are not limited thereto, and the server 200 may serve a fitting program for fitting a hearing aid and obtaining fitting parameter values of the hearing aid 300.

The method of fitting the hearing aid 300 may be a method of fitting the hearing aid 300 by using a hearing threshold for each frequency band. However, one or more exemplary embodiments are not limited thereto, and it will be understood by one of ordinary skill in the art that the fitting of the hearing aid 300 may be performed by using one of various methods.

In operation 1620, fitting parameter values of the hearing aid 300 are set according to the fitting of the hearing aid 300, which is performed in operation 1610. Although in the current embodiment, operation 1610 and operation 1620 are sequentially performed, operation of setting fitting parameter values of the hearing aid 300 may be performed in parallel with the fitting of the hearing aid 300.

In operation 1630, the hearing aid 300 transmits a fitting parameter model of the fitting parameter values set into the hearing aid 300 to the mobile terminal 100. The fitting parameter model denotes fitting parameter values of the hearing aid 300, which are fitted to be suitable for hearing characteristics of a user of the hearing aid 300 and characteristics of the location at which the hearing aid 300 was fitted.

In operation 1640, the mobile terminal 100 receives the fitting parameter model transmitted from the hearing aid 300.

In operation 1650, the mobile terminal 100 acquires location information about the location, at which the hearing aid 300 was fitted, by using a positioning system.

In operation 1660, the mobile terminal 100 uploads the hearing characteristics of the user, location information about a location at which the hearing aid 300 was fitted, and the fitting parameter model to the server 200. In this case, the mobile terminal 100 may upload the hearing characteristics of the user along with other information to the server 200. However, the mobile terminal 100 may not directly upload the hearing characteristics of the user to the server 200, but may upload the hearing characteristics to the server 200 by using another server (for example, the second server 210 of FIG. 6C) storing the hearing characteristics of the user, as explained with reference to FIG. 6C.

In operation 1670, the server 200 stores the fitting parameter model along with the hearing characteristics based on the location information. For example, the server 200 may map fitting parameter models of the hearing aid 300 to each location and may store the mapped fitting parameter models along with the hearing characteristics into a database.

Accordingly, as the server receives fitting parameter models from the mobile terminal 100 of the user and stores the received fitting parameter models along with the location information, the server 200 may provide a fitting parameter model mapped to each location to the mobile terminal 100.

Figure 17:
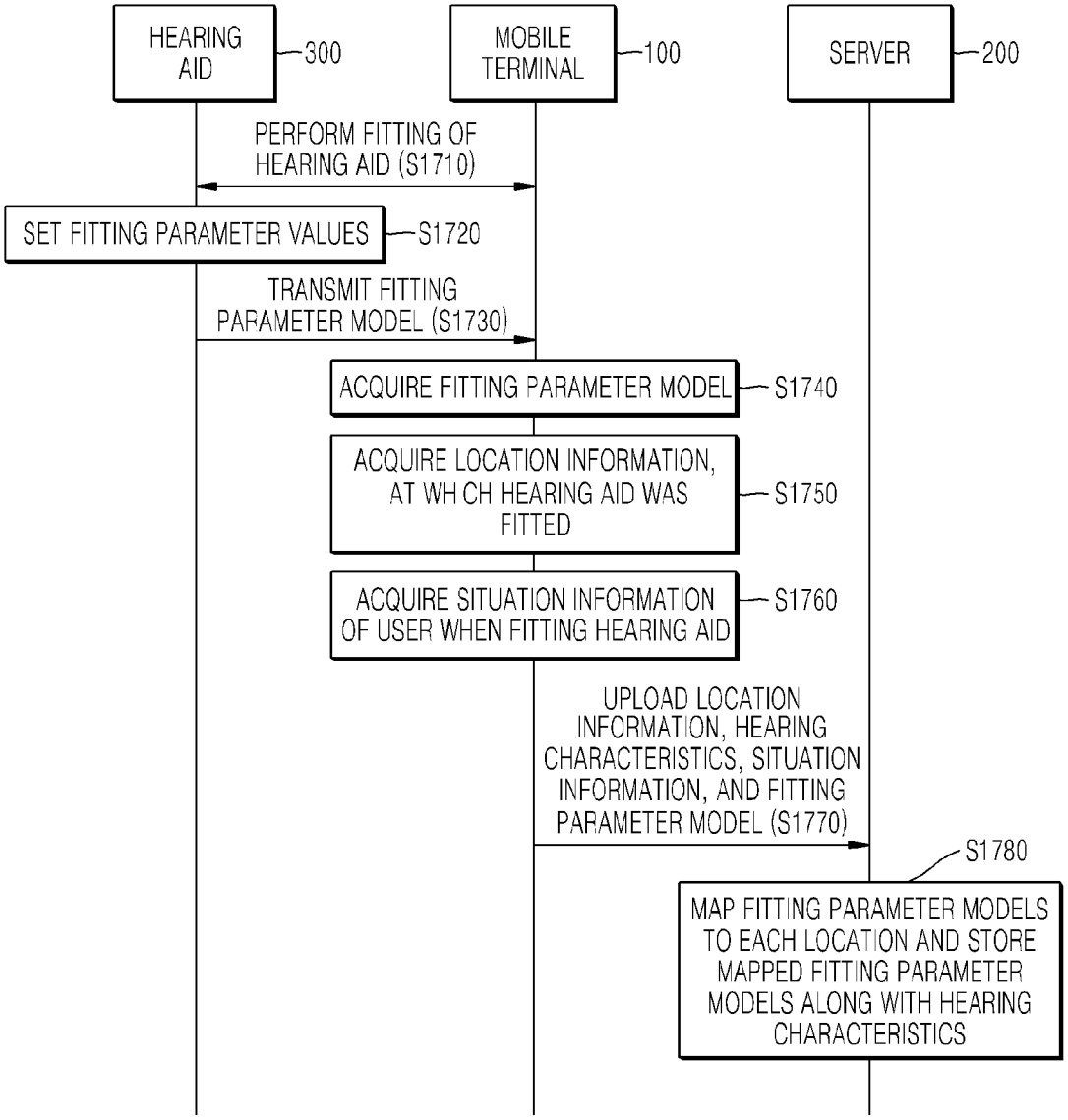
FIG. 17 is a flowchart illustrating a method of fitting a hearing aid and uploading a fitted fitting parameter model in association with location information to a server, in a mobile terminal, according to another exemplary embodiment.

FIG. 17 is a flowchart illustrating a method of fitting a hearing aid 300 and uploading a fitted fitting parameter model along with location information to a server 200, in a mobile terminal 100, according to another exemplary embodiment. Operations 1710 through 1750 illustrated in FIG. 17 are similar to operations 1610 through 1650 illustrated in FIG. 16, and thus, descriptions thereof are not repeated.

In operation 1710, the fitting of the hearing aid 300 is performed to be suitable for hearing characteristics of a user at a location by using the mobile terminal 100.

In operation 1720, fitting parameter values of the hearing aid 300 are set according to the fitting of the hearing aid 300, which is performed in operation 1710.

In operation 1730, the hearing aid 300 transmits a fitting parameter model of the fitting parameter values set into the hearing aid 300 to the mobile terminal 100.

In operation 1740, the mobile terminal 100 receives the fitting parameter model transmitted from the hearing aid 300.

In operation 1750, the mobile terminal 100 acquires location information about a location, at which the hearing aid 300 was fitted, by using a positioning system.

In operation 1760, the mobile terminal 100 acquires situation information of the user by using the situation information acquisition unit 170 when fitting the hearing aid 300. The situation information may indicate information about the surroundings, occasion, time, and situation of the user, which may be determined based on a sound or scene around the user when fitting the hearing aid 300. The situation information may be acquired through the microphone (not shown) of the hearing aid 300 and the microphone 172 or the camera 117 of the mobile terminal 100.

In operation 1770, the mobile terminal 100 uploads the hearing characteristics of the user, the location information about a location at which the hearing aid 300 was fitted, the situation information about the situation of the user when fitting the hearing aid 300, and the fitting parameter model to the server 200. In this case, the mobile terminal 100 may upload the hearing characteristics of the user along with other information to the server 200. However, the mobile terminal 100 may not directly upload the hearing characteristics of the user to the server 200, but may upload the hearing characteristics to the server 200 by using another server (for example, the second server 210 of FIG. 6C) storing the hearing characteristics of the user, as explained with reference to FIG. 6C.

In operation 1780, the server 200 stores the fitting parameter model along with the hearing characteristics and the situation information based on the location information. For example, the server 200 may map fitting parameter models of the hearing aid 300 to each location and may store the mapped fitting parameter models along with the hearing characteristics and the situation information into a database.

In this manner, as the server 200 provides a fitting parameter model mapped to each location along with the situation information to the mobile terminal 100, the user may select a fitting parameter model more suitable for situation of the user.

Figure 18:
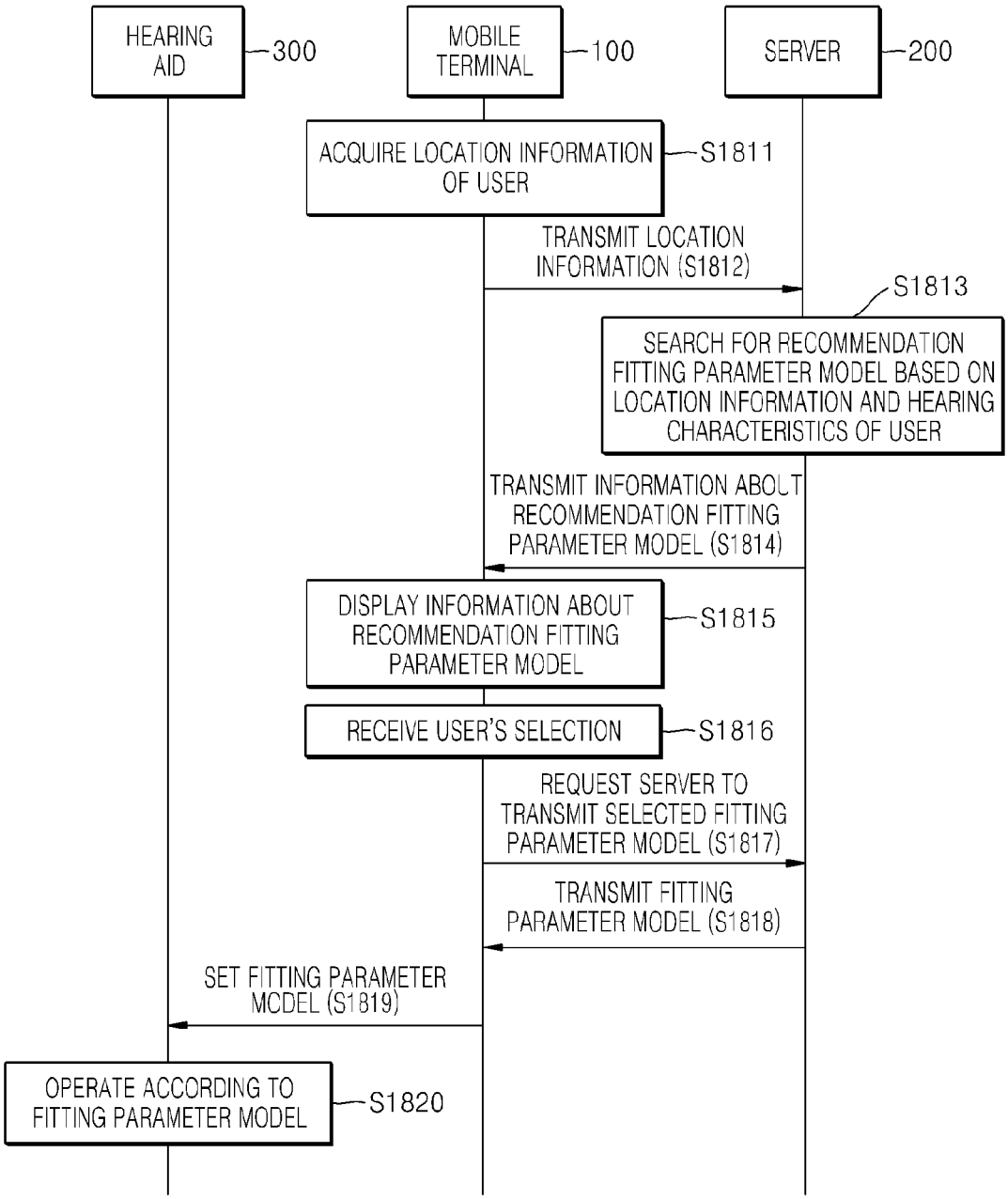
FIG. 18 is a flowchart illustrating a method of setting a recommended fitting parameter model provided from a server into a hearing aid, in a mobile terminal, according to an exemplary embodiment.

FIG. 18 is a flowchart illustrating a method of setting a recommended fitting parameter model provided from the server 200 into a hearing aid 300, in a mobile terminal 100, according to an exemplary embodiment.

In operation 1811 the mobile terminal 100 acquires location information of a user by using the positioning system 110.

In operation 1812, the mobile terminal 100 transmits the location information of the user to the server 200 through the communication interface unit 120.

In operation 1813, the server 200 searches for a recommended fitting parameter model, based on the location information and hearing characteristics of the user. For example, the server 200 searches for fitting parameter models corresponding to the location information in database in which fitting parameter models mapped to each location are stored, and finds fitting parameter models corresponding to the hearing characteristics from among the searched fitting parameter models. As a result of the search of the server 200, at least one fitting parameter model corresponding to the location information and the hearing characteristics of the user becomes a recommended fitting parameter model.

In operation 1814, the server 200 transmits information about a recommended fitting parameter model searched for in operation 1813 to the mobile terminal 100. The information about the recommended fitting parameter model may be a message indicating that there is at least one recommended fitting parameter model corresponding to location information of a user and hearing characteristics of the user.

In operation 1815, the mobile terminal 100 displays the received information about the recommended fitting parameter model through the user interface unit 150. For example, the mobile terminal 100 may receive information about three recommended fitting parameter models from the server 200, and may display numbers indicating the three recommended fitting parameter models on a screen.

In operation 1816, the mobile terminal 100 receives a selection of the user for any one of recommended fitting parameter models displayed through the user interface unit 150. In the above example in which numbers indicating the three recommended fitting parameter models are displayed on a screen, the user may select any one of the numbers indicating the three fitting parameter models displayed on the screen, and the selection of the user may be input to the mobile terminal 100 through the user interface unit 150.

In operation 1817, the mobile terminal 100 requests the server 200 to transmit a fitting parameter model selected by the user.

In operation 1818, the server 200 transmits a corresponding fitting parameter model to the mobile terminal 100 in response to the request of the mobile terminal 100. In this manner, in a manual fitting mode, the mobile terminal 100 does not directly receive a fitting parameter model searched for in the server 200. Instead, the mobile terminal 100 first receives information about a recommended fitting parameter, and then receives only a fitting parameter model, which the user desires to set, from the server 200.

For example, if the mobile terminal 100 receives information about three recommended fitting parameter models from the server 200, the mobile terminal 100 may receive only a fitting parameter model selected by the user from among the three recommended fitting parameter models.

In operation 1819, after receiving the fitting parameter model selected by the user, the mobile terminal 100 sets the received fitting parameter model into the hearing aid 300 connected to the mobile terminal 100.

In operation 1820, the hearing aid 300 operates according to the set fitting parameter model.

In the manual fitting model in which an informing on mode is set, a recommended fitting parameter model provided from the server 200 according to operations described above may be set into the hearing aid 300.

Figure 19:
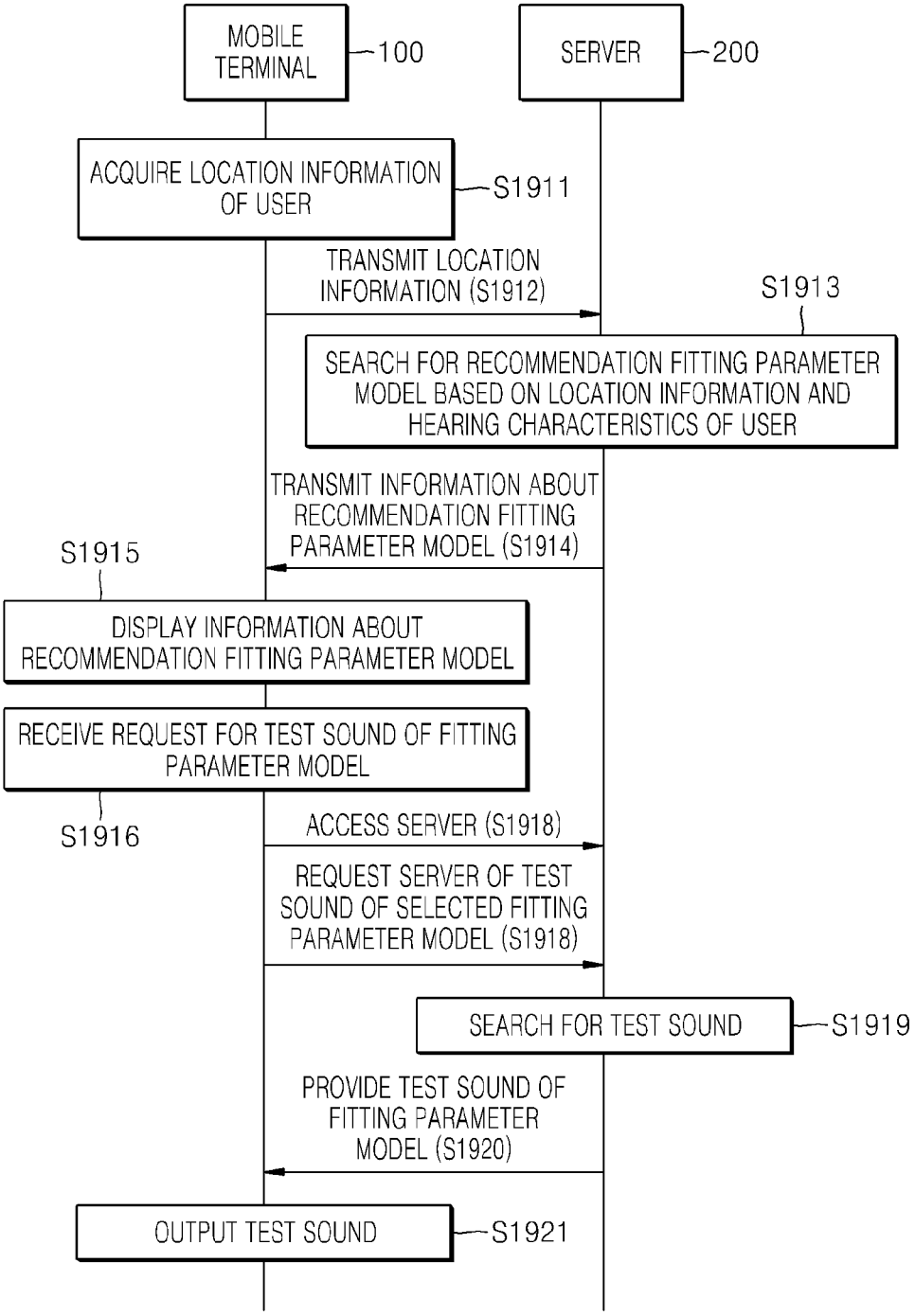
FIG. 19 is a flowchart illustrating a method of a providing a test sound of a fitting parameter model from a server to a mobile terminal, according to an exemplary embodiment.

FIG. 19 is a flowchart illustrating a method of a providing a test sound of a fitting parameter model from a server 200 to a mobile terminal 100, according to an exemplary embodiment. Operations 1911 through 1915 illustrated in FIG. 19 are similar to operations 1811 through 1815 illustrated in FIG. 18, and thus, descriptions thereof are not repeated.

In operation 1911 the mobile terminal 100 acquires location information of a user by using the positioning system 110.

In operation 1912, the mobile terminal 100 transmits the location information of the user to the server 200 through the communication interface unit 120.

In operation 1913, the server 200 searches for a recommended fitting parameter model, based on the location information and hearing characteristics of the user.

In operation 1914, the server 200 transmits information about a recommended fitting parameter model searched in operation 1913 to the mobile terminal 100.

In operation 1915, the mobile terminal 100 displays the received information about the recommended fitting parameter model through the user interface unit 150.

In operation 1916, the mobile terminal 100 receives a request for a test sound of a fitting parameter model from the user through the user interface unit 150. Because in the manual fitting mode, the mobile terminal 100 may receive only a fitting parameter model, which the user desires to set, from the server 200 after first receiving information about a recommended fitting parameter searched in the server 200, the user may determine whether to receive a recommended fitting parameter model from the server 200 after hearing a test sound of the recommended fitting parameter model selected by the user.

For example, the mobile terminal 100 may receive information about three recommended fitting parameter models and may display the information about the three recommended fitting parameter models on a screen, and the user may select one of the three recommended fitting parameter models displayed on the screen and may request pre-listening of a test sound of the selected fitting parameter model. The user's request for pre-listening of the test sound of the fitting parameter model selected by the user may be input to the mobile terminal 100 through the user interface unit 150.

In operation 1917, the mobile terminal 100 accesses the server 200.

In operation 1918, the mobile terminal 100 requests the server 200 of a test sound of the fitting parameter model selected by the user. The server 200 may provide a test sound of a fitting parameter model to the mobile terminal 100 through an application program included in the server 200.

In operation 1919, the server 200 searches for a test sound of a fitting parameter model. For example, the server 200 may store test sounds of various fitting parameter models, and may search for any one of test sounds stored in a memory (not shown) of the server 200 in response to a request of the mobile terminal 200.

In operation 1920, the server 200 provides a test sound of a fitting parameter model to the mobile terminal 100. For example, the server 200 may provide a test sound of a fitting parameter model to the mobile terminal 100 by executing an application program for providing a test sound of a fitting parameter model.

In operation 1921, the mobile terminal 100 outputs the test sound provided from the server 200. For example, the mobile terminal 100 may receive a test sound obtained by executing the application program of the server 200, and may output the received test sound through a speaker of the mobile terminal 100 or an earphone.

In this manner, the mobile terminal 100 may improve user convenience by providing a test sound of a fitting parameter model along with the fitting parameter model by using the server 200.

Figure 20:
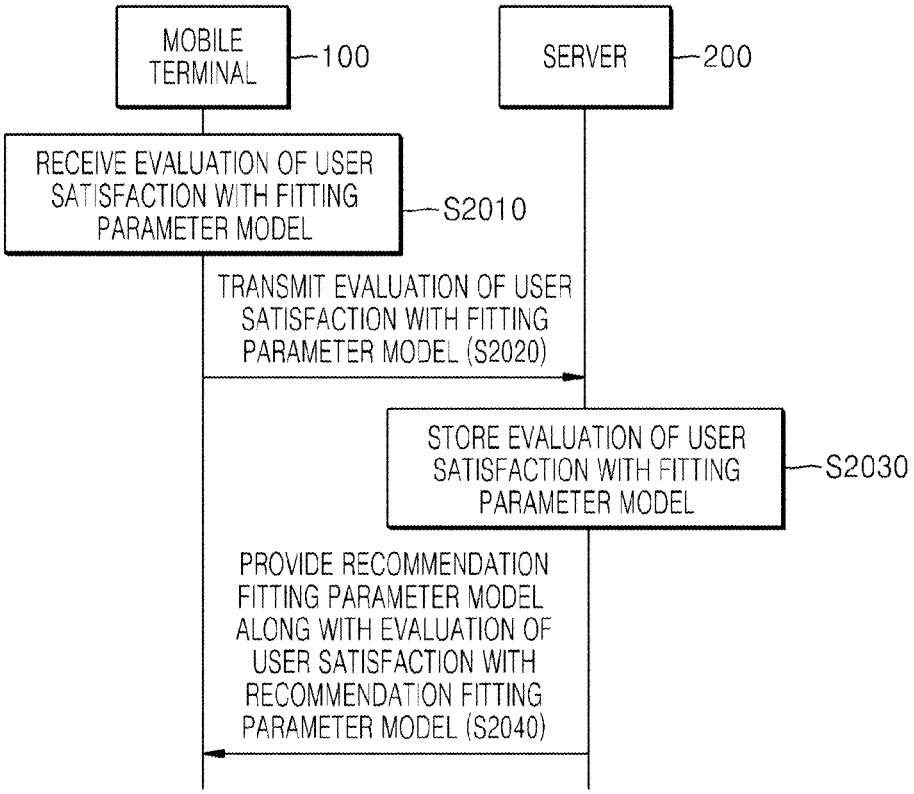
FIG. 20 is a flowchart illustrating a method of providing the evaluation of user satisfaction with a fitting parameter model, in a server, according to an exemplary embodiment.

FIG. 20 is a flowchart illustrating a method of providing the evaluation of user satisfaction with a fitting parameter model, in a server 200, according to an exemplary embodiment.

In operation 2010, the mobile terminal 100 receives the evaluation of user satisfaction with a fitting parameter model, which is input through the user interface unit 150. The evaluation of user satisfaction indicates the level of user satisfaction with a fitting parameter model after the user applies the fitting parameter model, which is received from the server 200 by using methods described with reference to FIGS. 1 through 19, to the hearing aid 300 and then uses the hearing aid 300.

The evaluation of user satisfaction may be performed by a way of rating a grade with respect to the level of satisfaction with a fitting parameter model. However, one or more exemplary embodiments are not limited thereto, and the evaluation of user satisfaction may be performed by a way of describing user comments with respect to the level of satisfaction with a fitting parameter model.

In operation 2020, the mobile terminal 100 transmits the evaluation of user satisfaction with the fitting parameter model to the server 200 through the communication interface unit 120.

In operation 2030, the server 200 stores the evaluation of user satisfaction with the fitting parameter model, which is received from the mobile terminal 100. For example, the server 200 may store the evaluation of user satisfaction with each fitting parameter model in a form of database.

In operation 2040, the server 200 may provide a recommended fitting parameter model along with the evaluation of user satisfaction with information about the recommended fitting parameter model when providing information about the recommended fitting parameter model to the mobile terminal 100. The evaluation of user satisfaction with the recommended fitting parameter model may be included in information about the recommended fitting parameter model. For example, when the mobile terminal 100 displays information about a recommended fitting parameter model through the user interface unit 150, the mobile terminal 100 may display the evaluation of user satisfaction with the recommended fitting parameter model as well as the recommended fitting parameter model so that a user may refer to the evaluation of user satisfaction in selecting the recommended fitting parameter model.

Accordingly, users may share the evaluation of satisfaction with fitting parameter models that are provided from the server 200, thereby improving the reliability of the fitting parameter models.

Other embodiments of the present invention can also be implemented through computer-readable code/instructions in/on a medium, e.g., a computer-readable medium, to control at least one processing element to implement any above-described embodiment. The medium can correspond to any medium/media permitting the storage and/or transmission of the computer-readable code.

The computer-readable code can be recorded/transferred on a medium in a variety of ways, with examples of the medium including recording media, such as magnetic storage media (e.g., ROM, floppy disks, hard disks, etc.) and optical recording media (e.g., CD-ROMs or DVDs), and transmission media such as Internet transmission media. Thus, the medium may be such a defined and measurable structure including or carrying a signal or information, such as a device carrying a bit stream according to one or more embodiments of the present invention. The media may also be a distributed network, so that the computer-readable code is stored/transferred and executed in a distributed fashion. Furthermore, the processing element could include a processor or a computer processor, and processing elements may be distributed and/or included in a single device.

It should be understood that the exemplary embodiments described therein should be considered in a descriptive sense only and not for purposes of limitation. Descriptions of features or aspects within each embodiment should typically be considered as available for other similar features or aspects in other embodiments.

What is claimed is:

1. A method of a mobile terminal for fitting a hearing aid connected to the mobile terminal, the method comprising:

acquiring location information comprising a location of the mobile terminal and movement information of the mobile terminal by using a positioning system;

acquiring situation information by using at least one of a camera disposed on the mobile terminal, a user input, and a microphone of the mobile terminal;

transmitting the location information and the situation information to a server;

determining to receive a fitting parameter model based on the movement information and the situation information;

receiving, from the server, the fitting parameter model corresponding to the situation information and the location information of the mobile terminal, and hearing characteristics of a user from among a plurality of fitting parameter models of the hearing aid; and controlling the hearing aid according to the fitting parameter model, wherein the situation information indicates at least one of surroundings, an occasion, and a situation of the user, which are determined based on at least one of an input, a sound, and a scene.

2. The method of claim 1, wherein the receiving comprises:

receiving, from the server, the fitting parameter model corresponding to the hearing characteristics of the user from among the plurality of fitting parameter models associated with the hearing aid that are mapped according to information about the location.

3. The method of claim 2, wherein the server stores the plurality of fitting parameter models associated with the hearing aid that are mapped to each location in association with the hearing characteristics.

4. The method of claim 1, further comprising:

acquiring the movement information of the mobile terminal by using at least one of an acceleration sensor and a geomagnetic sensor of the mobile terminal; and determining to receive the fitting parameter model based on the acquired movement information.

5. The method of claim 4, wherein it is determined to receive the fitting parameter model if a moving distance of the mobile terminal is greater than a predetermined distance based on the movement information.

6. The method of claim 4, it is determined to receive the fitting parameter model if the mobile terminal moves at a speed, which is less than a predetermined speed, based on the movement information.

7. The method of claim 1, further comprising:

receiving, from the server, a warning message that informs the user of an error zone where an abnormality of the hearing aid has occurred when the location information of the mobile terminal corresponds to the error zone registered in the server.

8. The method of claim 7, wherein the server stores records about the occurrence of the abnormality of the hearing aid with respect to each location, and registers error zones based on the records.

9. The method of claim 1, further comprising:

acquiring the situation information of the user by further using a microphone disposed on the mobile terminal; and transmitting the acquired situation information to the server, wherein the situation information indicates at least one of surroundings, occasion, and situation of the user, which are determined based on at least one of a sound or scene, and wherein the receiving of the fitting parameter model comprises receiving the fitting parameter model determined based on the location information, the hearing characteristics of the user, and the situation information.

10. The method of claim 1, further comprising:

generating a custom fitting parameter model for the hearing aid that is fitted by using a fitting program for fitting the hearing aid and obtaining fitting parameter values of the hearing aid, the fitting program being stored in at least one of the mobile terminal and the server;

acquiring fitting location information about a fitting location, at which the hearing aid is fitted, by the positioning system; and uploading the fitting location information and the custom fitted fitting parameter model from the mobile terminal to the server.

11. The method of claim 10, further comprising:

acquiring the situation information during the fitting of the hearing aid by further using a microphone disposed on the mobile terminal; and uploading the situation information from the mobile terminal to the server, wherein the situation information indicates at least one of surroundings, occasion, and situation of the user that are determined based on at least one of a sound and scene.

12. The method of claim 1, wherein the hearing characteristics of the user are transmitted to the server from at least one of the mobile terminal and another server.

13. The method of claim 1, further comprising:

transmitting authentication information of the user to a second server, wherein the second server transmits the hearing characteristics of the user to the server based on the authentication information of the user, and wherein the server determines the fitting parameter model based on the location information and the hearing characteristics of the user from the second server.

14. The method of claim 1, wherein the hearing aid is connected to the mobile terminal by using a wireless local area network (LAN) technology.

15. A method of fitting a hearing aid connected to a mobile terminal, the method comprising:

acquiring information comprising a location of the mobile terminal and movement information of the mobile terminal by using a positioning system;

acquiring situation information by using at least one of a camera disposed on the mobile terminal and a microphone disposed on the mobile terminal;

transmitting the location information and the situation information to a server;

determining to receive a fitting parameter model based on the movement information and the situation information;

receiving, from the server, information about at least one recommended fitting parameter model corresponding to the situation information and the location information of the mobile terminal, and hearing characteristics of a user of the hearing aid;

displaying the information about the at least one recommended fitting parameter model;

receiving the fitting parameter model selected by the user from among the at least one recommended fitting parameter model; and controlling the hearing aid according to the received fitting parameter model, wherein the situation information indicates at least one of surroundings, an occasion, and a situation of the user, which are determined based on at least one of a sound or a scene.

16. The method of claim 15, wherein the recommended fitting parameter model corresponds to at least one fitting parameter model corresponding to the hearing characteristics of the user from among a plurality of fitting parameter models mapped to the location.

17. The method of claim 16, wherein the server stores fitting parameter models of the hearing aid, that are mapped to each location, in association with the hearing characteristics.

18. The method of claim 15, wherein the information about the recommended fitting parameter model comprises:

a message indicating that there is at least one recommended fitting parameter model determined based on the location information of the mobile terminal and the hearing characteristics of the user.

19. The method of claim 15, wherein the server is a cloud server, and the method further comprising outputting, from the server, a test sound to the hearing aid to which the recommended fitting parameter model is applied, by connecting the mobile terminal to the cloud server.

20. The method of claim 15, further comprising:

receiving an evaluation of satisfaction with the received fitting parameter model from the user; and transmitting the received evaluation of satisfaction to the server, wherein the information about the recommended fitting parameter model comprises the evaluation of satisfaction.

21. The method of claim 20, wherein the server stores a fitting parameter model for each location in association with the corresponding evaluation of satisfaction.

22. The method of claim 15, wherein the hearing aid is connected to the mobile terminal by using a wireless local area network (LAN) technology.

23. The method of claim 15, further comprising:

receiving, from the server, a warning message that informs the user of an error zone where an abnormality of the hearing aid has occurred when the location information of the user corresponds to the error zone registered on the server.

24. The method of claim 15, further comprising:

generating a custom fitting parameter model for the hearing aid that is fitted by using a fitting program for fitting the hearing aid and obtaining fitting parameter values of the hearing aid, the fitting program being stored in at least one of the mobile terminal and the server;

acquiring fitting location information about a fitting location, at which the hearing aid is fitted, by a positioning system; and uploading the fitting location information and the custom fitted fitting parameter model from the mobile terminal to the server.

25. A non-transitory computer-readable medium having recorded thereon a computer program that is executable by a computer to perform the method of claim 1.

26. A mobile terminal connected to a hearing aid, the mobile terminal comprising:

a positioning system configured to acquire information comprising a location of the mobile terminal and movement information of the mobile terminal;

a situation information acquisition unit configured to acquire situation information from the user, wherein the situation information indicates surroundings of the user, which are determined based on a scene, a processor configured to determine whether to receive a fitting parameter model if a moving distance of the mobile terminal is greater than a predetermined distance based on the movement information;

a communication interface configured to transmit the situation information and the location information of the mobile terminal to a server, and receive, from the server, the fitting parameter model corresponding to the situation information and the location information of the mobile terminal and hearing characteristics of a user from among fitting parameter models of the hearing aid; and a control unit configured to control the hearing aid according to the fitting parameter model, wherein the situation information further indicates at least one of an occasion, and a situation of the user, which are determined based on a sound.

27. The mobile terminal of claim 26, further comprising:

a user interface unit configured to receive a fitting mode input selection from the user, selecting between a manual fitting mode and an automatic fitting mode.

28. The mobile terminal of claim 26, further comprising a processor configured to determine to receive the fitting parameter model from the server when the received fitting mode selected is an automatic fitting mode, wherein the communication interface unit receives the fitting parameter model, and wherein the setting unit sets the received fitting parameter model into the hearing aid in response to the reception of the fitting parameter model.

29. The mobile terminal of claim 27, further comprising a processor configured to determine to receive a message, indicating that there is at least one recommended fitting parameter model determined based on the location information of the mobile terminal and the hearing characteristics of the user, in advance to receive the fitting parameter model from the server, wherein the communication interface unit receives the message from the server when the received fitting mode is the manual mode.

30. The mobile terminal of claim 27, further comprising:

a memory configured to store at least one fitting parameter model, wherein the user interface unit displays the at least one fitting parameter model stored in the memory and receives selection by the user of any one fitting parameter model from among the displayed at least one fitting parameter model when the received fitting mode is in the manual mode, and wherein the setting unit sets the received fitting parameter model into the hearing aid.

31. The mobile terminal of claim 26, further comprising a user interface unit configured to receive an informing mode which is input from the user between an informing "on" mode for receiving at least one recommended fitting parameter model and an informing "off" mode; and a processor configured to determine whether to receive information about the recommended fitting parameter model according the received informing mode, wherein, when the received informing mode is the informing "on" mode, the processor determines to receive information about at least one recommended fitting parameter model in advance to receive the fitting parameter model from the server, the communication interface unit receives the information about the at least one recommended fitting parameter model from the server, the user interface unit displays the information about the at least one recommended fitting parameter model and receives any one fitting parameter model selected by the user from among the at least one recommended fitting parameter model.

32. The mobile terminal of claim 31, wherein the user interface unit receives an evaluation of satisfaction with the received recommended fitting parameter model from the user, and the communication interface unit transmits the received evaluation of satisfaction to the server, wherein the information about the recommended fitting parameter model comprises the evaluation of satisfaction.

33. The mobile terminal of claim 26, further comprising:

a movement information acquisition unit configured to acquire movement information of the mobile terminal; and a processor configured to determine whether to receive the fitting parameter model based on the acquired movement information.

34. The mobile terminal of claim 26, wherein the communication interface unit receives, from the server, a warning message, that informs the user of an error zone where an abnormality of the hearing aid has occurred when the location information of the mobile terminal corresponds to the error zone registered on the server.

35. The mobile terminal of claim 26, further comprising:

a fitting unit configured to acquire a fitting parameter model of the hearing aid of the user, that is fitted by using a fitting program for fitting the hearing aid and obtaining a fitting parameter of the hearing aid, the fitting program being stored in the mobile terminal or the server, wherein the positioning system acquires location information about a location at which the hearing aid is fitted, and the communication interface unit uploads the location information and the fitted fitting parameter model from the mobile terminal to the server.

36. A non-transitory computer-readable medium having recorded thereon a computer program that is executable by a computer to perform the method of claim 15.

37. A method executed on a user equipment that is communicatively connected to a hearing aid, the method comprising: acquiring location information of the user equipment by using a positioning system; acquiring situation information by using at least one of a camera disposed on the user equipment, a user input, and a microphone of the user equipment; determining a fitting parameter model for the hearing aid based on the location information and the movement information and the situation information; receiving, from a server, the fitting parameter model corresponding to the situation information and the location information of the user equipment, and hearing characteristics of a user from among a plurality of fitting parameter models of the hearing aid; and controlling the hearing aid according to the fitting parameter model, wherein the situation information indicates at least one of surroundings, an occasion, and a situation of the user, which are determined based on at least one of an input, a sound, and a scene.

38. The method of claim 37, wherein controlling the hearing aid comprises:

transmitting, from the user equipment, at least one of a signal, a fitting parameter model value, and the fitting parameter model to the hearing aid.

* * * * *